US011623117B2

(12) United States Patent
Abelbeck

(10) Patent No.: US 11,623,117 B2
(45) Date of Patent: Apr. 11, 2023

(54) EXERCISE DEVICE

(71) Applicant: Kevin Gene Abelbeck, Fort Collins, CO (US)

(72) Inventor: Kevin Gene Abelbeck, Fort Collins, CO (US)

(73) Assignee: Abelbeck Partners, LLC, Alcoa, TN (US)

( * ) Notice: Subject to any disclaimer, the term of this patent is extended or adjusted under 35 U.S.C. 154(b) by 55 days.

(21) Appl. No.: 17/405,347

(22) Filed: Aug. 18, 2021

(65) Prior Publication Data

US 2021/0370128 A1 Dec. 2, 2021

Related U.S. Application Data

(62) Division of application No. 15/609,910, filed on May 31, 2017, now Pat. No. 11,123,598.

(60) Provisional application No. 62/358,517, filed on Jul. 5, 2016.

(51) Int. Cl.

| | |
|---|---|
| ***A63B 22/00*** | (2006.01) |
| ***A63B 22/06*** | (2006.01) |
| ***A63B 23/04*** | (2006.01) |
| ***A63B 21/015*** | (2006.01) |
| ***A63B 21/00*** | (2006.01) |

(Continued)

(52) U.S. Cl.

CPC ..... *A63B 22/001* (2013.01); *A63B 21/015* (2013.01); *A63B 21/154* (2013.01); *A63B 21/225* (2013.01); *A63B 21/4033* (2015.10); *A63B 21/4034* (2015.10); *A63B 21/4035* (2015.10); *A63B 22/0056* (2013.01); *A63B 22/0664* (2013.01); *A63B 23/0423* (2013.01); *A63B 24/0087* (2013.01); *A63B 21/151* (2013.01); *A63B 2022/0051* (2013.01); *A63B 2022/0676* (2013.01); *A63B 2022/0688* (2013.01)

(58) Field of Classification Search

None

See application file for complete search history.

(56) References Cited

U.S. PATENT DOCUMENTS

| | | | |
|---|---|---|---|
| 219,439 | A | 9/1879 | Blend |
| 2,872,191 | A | 2/1959 | Gallo, Sr. |
| 3,758,111 | A | 9/1973 | Agamian |

(Continued)

FOREIGN PATENT DOCUMENTS

| | | |
|---|---|---|
| EP | 2000178 A1 | 12/2008 |
| TW | I332410 | 12/2008 |

*Primary Examiner* — Sundhara M Ganesan
*Assistant Examiner* — Shila Jalalzadeh Abyaneh

(57) ABSTRACT

An exercise device of the type including a frame with a first crank assembly rotatably coupled to the frame about a first axis and a second crank assembly rotatably coupled to the frame about a second axis. A control system may be used in communication with the first crank assembly and the second crank assembly, which may provide a synchronous movement of the first crank assembly relative to the second crank assembly. A pedal arm may be provided with a first end pivotally coupled to the first crank assembly and a pedal positioned on a second end. A crank link may be used with one end coupled to the second crank assembly and a second end coupled to the pedal arm. The crank link may be movable on the pedal arm which may provide varying paths of motion of the pedals.

1 Claim, 20 Drawing Sheets

(51) Int. Cl.
*A63B 21/22* (2006.01)
*A63B 24/00* (2006.01)

(56) References Cited

U.S. PATENT DOCUMENTS

| | | | | |
|---|---|---|---|---|
| 3,759,511 | A | 9/1973 | Zinkin et al. | |
| 3,820,820 | A | 6/1974 | Kutz | |
| 4,185,622 | A | 1/1980 | Swenson | |
| 4,188,030 | A | 2/1980 | Hooper | |
| 4,470,597 | A | 9/1984 | McFee | |
| 4,564,206 | A | 1/1986 | Lenhardt | |
| 4,712,790 | A | 12/1987 | Szymski | |
| 4,779,863 | A | 10/1988 | Yang | |
| 4,786,050 | A | 11/1988 | Geschwender | |
| 4,850,585 | A | 7/1989 | Dalebout | |
| 5,135,447 | A | 8/1992 | Robards, Jr. et al. | |
| 5,290,211 | A | 3/1994 | Stearns | |
| 5,401,226 | A | 3/1995 | Stearns | |
| 5,433,680 | A | 7/1995 | Knudsen | |
| 5,527,246 | A | 6/1996 | Rodgers, Jr. | |
| 5,529,555 | A | 6/1996 | Rodgers, Jr. | |
| 5,540,637 | A | 7/1996 | Rodgers, Jr. | |
| 5,549,526 | A | 8/1996 | Rodgers, Jr. | |
| 5,573,480 | A | 10/1996 | Rodgers, Jr. | |
| 5,577,985 | A | 10/1996 | Miller | |
| 5,591,107 | A | 1/1997 | Rodgers, Jr. | |
| 5,637,058 | A | 6/1997 | Rodgers, Jr. | |
| 5,707,321 | A | 1/1998 | Maresh | |
| 5,725,457 | A | 3/1998 | Maresh | |
| 5,792,028 | A * | 8/1998 | Jarvie | A63B 22/0664 482/52 |
| 5,800,315 | A | 9/1998 | Yu et al. | |
| 5,876,307 | A * | 3/1999 | Stearns | A63B 22/001 482/51 |
| 5,876,308 | A | 3/1999 | Jarvie | |
| 5,897,463 | A | 4/1999 | Maresh | |
| 6,004,244 | A | 12/1999 | Simonson | |
| 6,083,143 | A | 7/2000 | Maresh | |
| 6,248,044 | B1 | 6/2001 | Stearns et al. | |
| 6,398,695 | B2 | 6/2002 | Miller | |
| 6,409,632 | B1 | 6/2002 | Eschenbach | |
| 6,461,277 | B2 | 10/2002 | Maresh et al. | |
| 6,482,132 | B2 | 11/2002 | Eschenbach | |
| 6,551,218 | B2 | 4/2003 | Goh | |
| 6,949,054 | B1 | 9/2005 | Stearns et al. | |
| 7,060,005 | B2 | 6/2006 | Carlsen et al. | |
| 7,086,993 | B1 | 8/2006 | Maresh | |
| 7,137,927 | B2 | 11/2006 | Maresh et al. | |
| 7,169,089 | B2 | 1/2007 | Rodgers, Jr. | |
| 7,285,075 | B2 | 10/2007 | Cutler et al. | |
| 7,344,480 | B2 | 3/2008 | Maresh et al. | |
| 7,485,080 | B1 | 2/2009 | Chuang et al. | |
| 7,520,839 | B2 | 4/2009 | Rodgers, Jr. | |
| 7,530,926 | B2 | 5/2009 | Rodgers, Jr. | |
| 7,556,691 | B2 | 7/2009 | Chuang et al. | |
| 7,608,018 | B2 | 10/2009 | Chuang et al. | |
| 7,611,446 | B2 | 11/2009 | Chuang et al. | |
| 7,645,215 | B2 | 1/2010 | Gordon | |
| 7,651,445 | B1 | 1/2010 | Chen | |
| 7,708,669 | B2 | 5/2010 | Rodgers, Jr. | |
| 7,833,134 | B2 | 11/2010 | Gordon | |
| 7,862,482 | B1 | 1/2011 | Hsu | |
| 8,109,861 | B2 | 2/2012 | Gordon et al. | |
| 8,740,754 | B2 | 6/2014 | Miller | |
| 9,073,597 | B2 | 7/2015 | Rundini | |
| 9,630,052 | B2 | 4/2017 | Peng | |
| 9,925,412 | B1 * | 3/2018 | Lu | A63B 22/001 |
| 2002/0123412 | A1 * | 9/2002 | Nguyen | A63B 22/001 482/57 |
| 2005/0124466 | A1 | 6/2005 | Rodgers, Jr. | |
| 2006/0172865 | A1 * | 8/2006 | Dey | A63B 22/001 482/52 |
| 2008/0051258 | A1 | 2/2008 | Schmehl et al. | |
| 2008/0261778 | A1 | 10/2008 | Chuang et al. | |
| 2008/0269023 | A1 | 10/2008 | Chuang et al. | |
| 2011/0039662 | A1 * | 2/2011 | Gordon | A63B 21/155 482/52 |
| 2014/0249000 | A1 * | 9/2014 | Lu | A63B 22/001 482/52 |

* cited by examiner

EXERCISE DEVICE

CROSS-REFERENCE TO RELATED APPLICATION DATA

This application is a divisional application of U.S. patent application Ser. No. 15/609,910, filed May 31, 2017, which claims priority to Provisional Application No. 62/358,517, filed on Jul. 5, 2016, which is incorporated by reference herein.

FIELD OF THE INVENTION

The present invention generally relates to exercise equipment, and more particularly, to exercise devices in which a user's feet are supported on a pair of pedals and the user may perform one or more movements while supported on the pedals.

BACKGROUND OF THE INVENTION

The need for physical exercise is especially important in today's world of drive through windows and sitting in front of a computer all day. It is suggested that cardiovascular exercise is most beneficial if the user can obtain an elevated heart rate for at least twenty minutes of sustained exercise. This type of exercise may vary according to the needs and personal preference of the user, but for many people a movement that employs larger muscles, such as those which move the legs and hips may be desirable, as these are capable of doing the most work. For many sedentary individuals the accumulation of excess bodyfat may be a concern. The more work the body does, the more energy the body uses to perform that work. In the human body, most energy storage is in the form of bodyfat. Therefore, using larger muscles to do more work may enable a quicker end result on reducing bodyfat and increasing cardiovascular health. Adding an upper body system to an exercise device may further help by taxing additional muscle groups and increase the work output of the body over time.

It may be beneficial for the user to perform an activity that has a familiar basis to the normal function of the body, such as walking or running. Walking may be preferred for many users, as the impact forces on the legs are less compared to those found in running for the same person, even at the same speed. Using a walking motion may enable some participants to perform the activity that they could not perform under the higher running loads. Also, the lower impact stress may allow some people to perform the activity longer and therefore have a higher cumulative energy expenditure compared to running, even considering the higher energy expenditure per unit of time with running as compared to walking. Increasing the energy expenditure and still maintaining a walking gait may be accomplished by increasing the force required to move the pedals of a machine that simulates walking, or altering the angle to simulate walking up a hill. Either or both may provide a useful alternative to walking on a street or road where the user may be subjected to extreme weather conditions, traffic or physical dangers not found in their home or other controlled environment.

Treadmills have typically been used, but they can be large, expensive and noisy. The noise is due at least partially to the friction between the moving belt and the supporting deck under the belt that occurs with each step. Where there is friction there is wear. The decks must be regularly replaced or lubricated and the belts replaced.

It should, therefore, be appreciated that there is a need for an exercise device that allows the user to simulate walking or other bipedal movement that can be done indoors, with a small footprint and with minimal noise and parts wear. The present invention fulfills this need and others.

SUMMARY OF THE INVENTION

The present invention may include a frame and a first crank assembly rotateably coupled to the frame about a first axis and a second crank assembly rotateably coupled to the frame about a second axis. The first crank assembly and the second crank assembly may each provide a first crank arm and a second crank arm displaced from each other such that a user may be positioned there between. The first crank arm and the second crank arm may be positioned 180 degrees out of phase from each other. In addition, the first crank arm of the first crank assembly and the first crank arm of the second crank assembly may be parallel to each other.

A control system may be provided that may be in communication with the first crank assembly and the second crank assembly, the control system may provide a synchronous movement of the first crank assembly relative to the second crank assembly. A pedal arm may have a first end pivotally coupled to the first crank assembly and a pedal positioned on a second end of the pedal arm. In addition, a crank link may have one end coupled to the second crank assembly and a second end coupled to the pedal arm. The first crank link may be movably coupled to a location on the first pedal arm and then moved to a second position on the first pedal arm, thereby changing the path of movement of the pedals.

The control system may include a drive shaft rotateably connected to the frame, which may provide mechanical communication between the first crank arm and the second crank arm of the first crank assembly. The control system may also include a drive member selected from the groups consisting of a belt, roller chain, a synchronous belt, a v-belt and a poly-v belt. The control system may also include a torque linkage including a link rod rotateably coupled to the second crank assembly and the drive shaft. The torque linkage may transfer power between the second crank assembly and the drive shaft operating in cooperation with the drive member. A braking system may be provided that may be in mechanical communication with the drive shaft, which may provide a resistance to movement of first crank arm and the second crank arm of the first crank assembly and the second crank assembly.

The exercise device may also include a drive frame which may support the first crank assembly and the second crank assembly. The drive frame may be movably mounted to a base frame, such that the orientation of the first axis or the second axis may be altered with respect to the base frame and thereby vary the path of the pedals.

The system may include a pair of drive handles pivotally coupled to the frame, each one of the pair of drive handles may include a hand grip on a first end and a drive lever on a second end. A handle link may also be provided with a first end pivotally coupled to the first crank assembly and a second end pivotally coupled to the drive lever.

For purposes of summarizing the invention and the advantages achieved over the prior art, certain advantages of the invention have been described herein. Of course, it is to be understood that not necessarily all such advantages can be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment(s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 1:
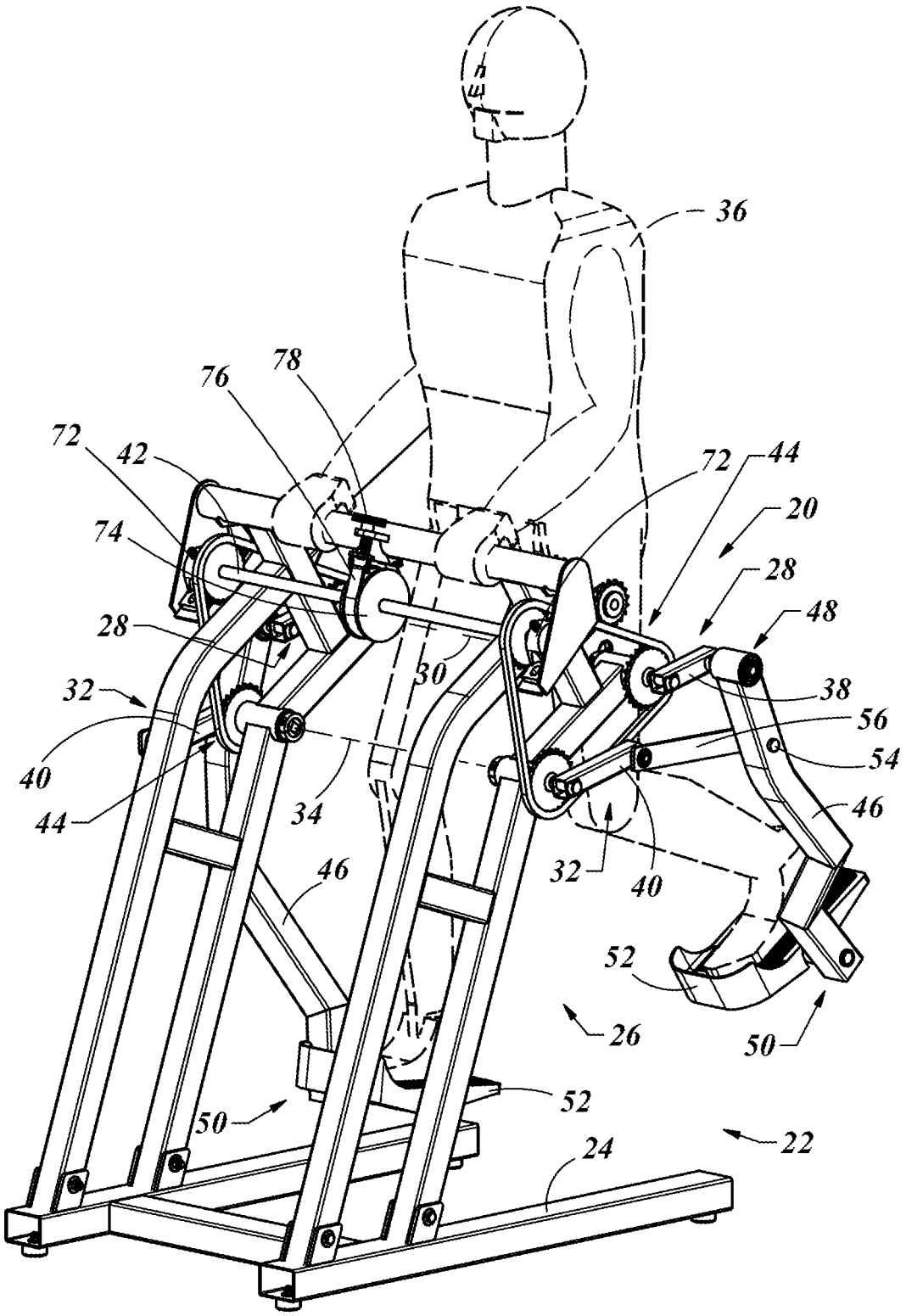
FIG. 1 is an isometric view of an exercise device, presented in accordance with the present invention.
Figure 2:
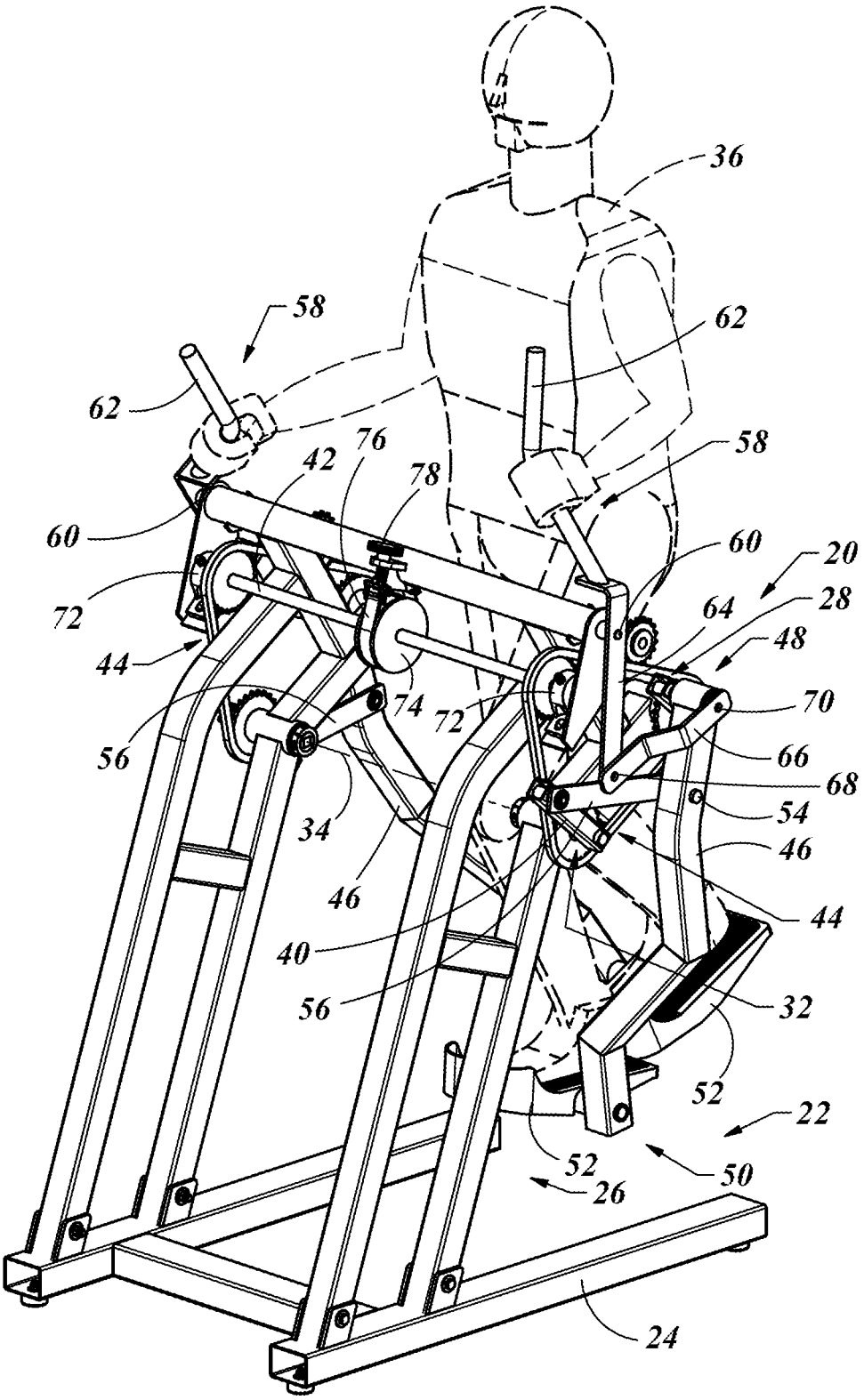
FIG. 2 is an isometric view of an exercise device which includes drive handles, the figure presented in accordance with the present invention.
Figure 3:
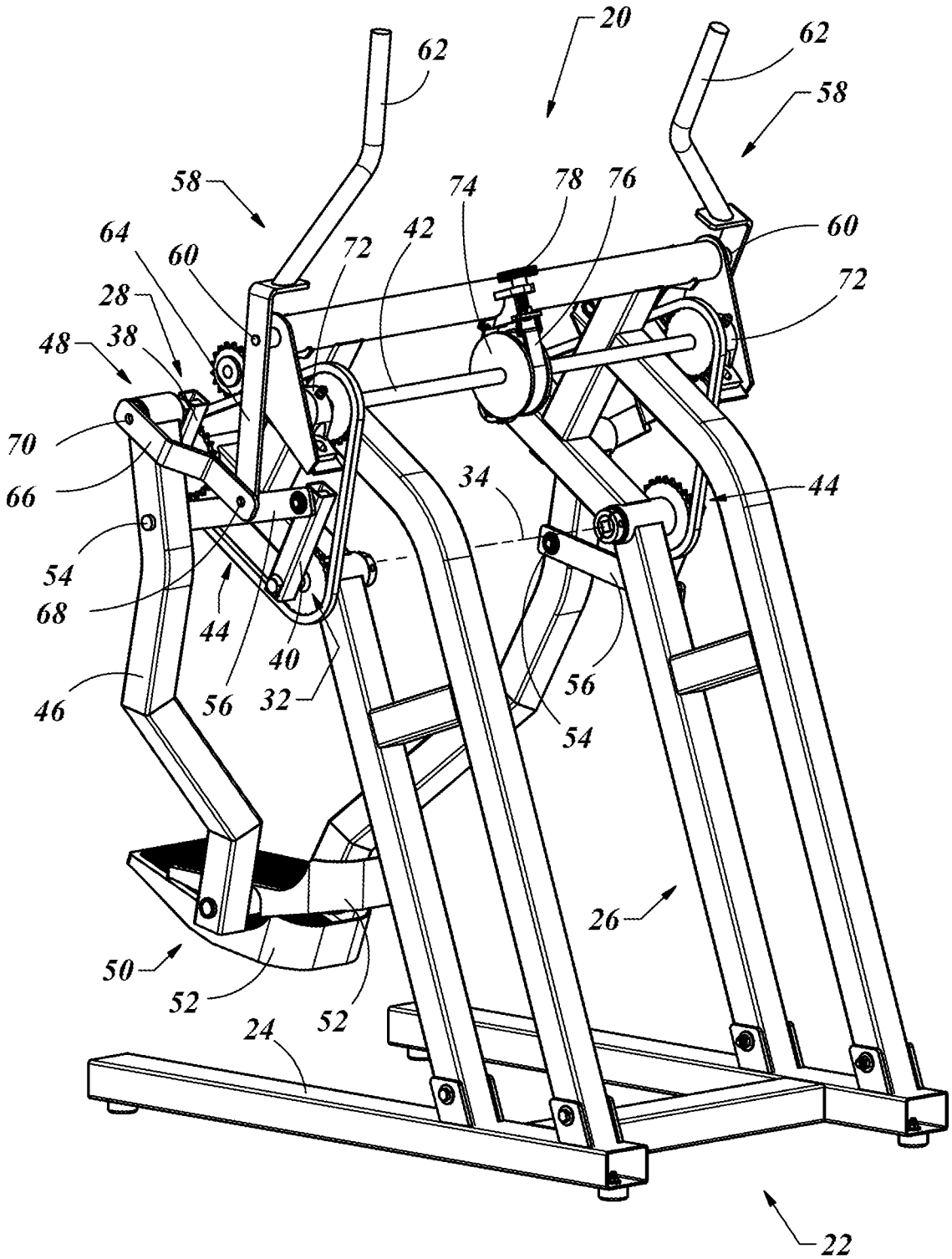
FIG. 3 is an isometric view of the exercise device shown as shown in FIG. 2, shown without a simulated user and from a right front viewpoint.
Figure 4:
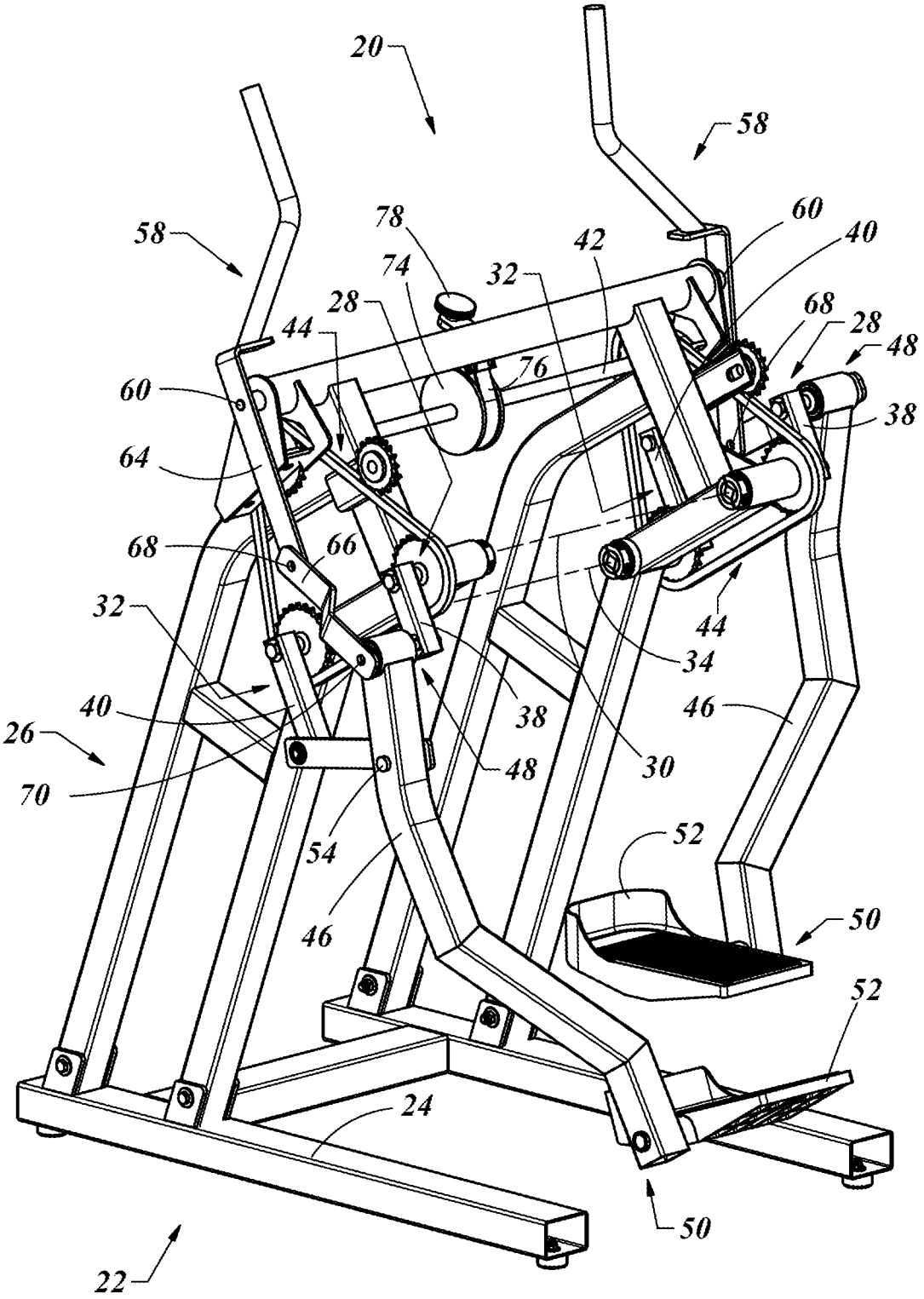
FIG. 4 is an isometric view from the left rear of the exercise device as shown in FIG. 3.

With reference to the illustrative drawings, and particularly to FIG. 1, there is shown an exercise device 20. The exercise device 20 may include a frame 22, which may include a base frame 24 and a support frame 26. The support frame 26 may be adapted to support a first crank assembly 28, which may be journaled to the support frame 26 to allow for rotational movement of the first crank assembly 28 about a first axis 30. A second crank assembly 32 may be journaled to the support frame 26 about a second axis 34. In this disclosure the locations of the first axis 30 and the second axis 34 may be positioned to cause a potential interference with a user 36 using the exercise device 20. To solve this problem, the first crank assembly 28 and the second crank assembly 32 may each be split into a left crankset and a right crankset. To maintain that the first crank arms 38 and the second crank arms 40 of the first crank assembly 28 and the second crank assembly 32 respectively, may be positioned to be 180° out of phase with the other crank arm (38 and 40) of each crankset (28 and 32), a drive shaft 42 may also be journaled to the support frame 26 as illustrated.

It may be desirable for the first crank assembly 28 and the second crank assembly 32 to move in a synchronous manner with respect to one another. This may be accomplished by the use of a control system 44. The control system 44 may be comprised of a roller chain, a drive belt, a gearing system or any other mechanical transmission elements known in the art. In that the first axis 30 and the second axis 34 may not allow a direct communication between the right and left portions of the first crank assembly 28 or the second crank assembly 32, the control system 44 may also be in mechanical communication with the driveshaft 42. In that the driveshaft 42 may be located in position to mechanically span the entire width of the exercise device 20, the driveshaft 42 with the control system 44 may then act to connect the left and right portions of each of the first crank assembly 28 and the second crank assembly 32 as well as provide for synchronous rotation of the first crank assembly 28 with respect to the second crank assembly 32.

A pedal arm 46 may be rotatably coupled to the first crank assembly 28 on a first end 48 of the pedal arm 46. On a second end 50 of the pedal arm 46 a pedal 52 may be provided, which may be adapted to support the weight of the user 36. Between the first end 48 and the second end 50 of the pedal arm 46, a crank link pin 54 may be provided. The crank link pin 54 may be pivotally coupled to a crank link 56 and the crank link 56 may also be coupled to the second crank assembly 32, thereby connecting the pedal arm 46 to the second crank assembly 32.

It is important to note that in these preferred embodiments of the exercise device 20, the drive shaft 42 is positioned such that it is not in line with the first axis 30 or the second axis 34. That is because both the first axis 30 and the second axis 34 may be positioned to potentially interfere with the movement of the user 36. As such, the drive shaft 42 may be moved to a position that is unlikely to interfere with the movement of the legs of the user 36. It is possible that the second axis 34, and the second crank assembly 32, could be moved far enough forward to avoid the legs of the user 36. If that were done, the drive shaft 42 could directly connect the second crank assembly 32. The crank link 56 may then be increased in length in accordance with the increase in dimension of the relocation of the second axis 34 relative to the current position. This would eliminate the need for some components in the system. The applicant recognizes this could be done and hereby includes this as a variation to the disclosed embodiments even though this is not shown in any of the figures.

With reference to FIGS. 2-5, a similar exercise device 20 is shown with the addition of drive handles 58, which may be pivotally coupled to the frame 22 about a pivot pin 60. The drive handles 58 may each include a hand grip 62 adapted to be gripped by the hands of the user 36. The drive handles 58 may also include a drive lever 64, which may be coupled to a handle link 66 about a pivot 68. The handle link 66 may include a second pivot 70, which may be mounted to the first crank assembly 28 at second pivot 70. Therefore, the user 36 may be positioned on the pedals 52 of the pedal arms 46 and perform a walking motion such that the first crank assembly 28 may provide a vertical displacement of each pedal arm 46, and therefore the pedal 52, while the second crank assembly 32 may provide for horizontal displacement of the pedal 52 by way of the crank link 56. This movement may drive the driveshaft 42, thus causing it to rotate about the bearings 72, which may be mounted to the support frame 26 of the frame 22.

To provide a smooth movement of the pedals 52 a flywheel 74 may be coupled to the driveshaft 42, whereby rotation of the driveshaft 42 about the bearings 72 may cause a similar rotation of the flywheel 74. It may also be desirable to include a braking system to resist the movement of the pedals 52. A braking system may include a friction strap 76 mounted to a screw 78, which may be mounted to the support frame 26. Therefore, as the screw 78 is advanced this may increase the tension in the friction strap 76, which may increase the drag and therefore increase the resistance to movement of the flywheel 74. This may increase the work necessary to be provided by the user 36, thus increasing the intensity of the exercise. In a similar manner, any magnetic form of resistance known to the art, such as an electric motor, an eddy current brake or any other braking system may be used in place of the combination of the friction strap 76 and screw 78.

Figure 5:
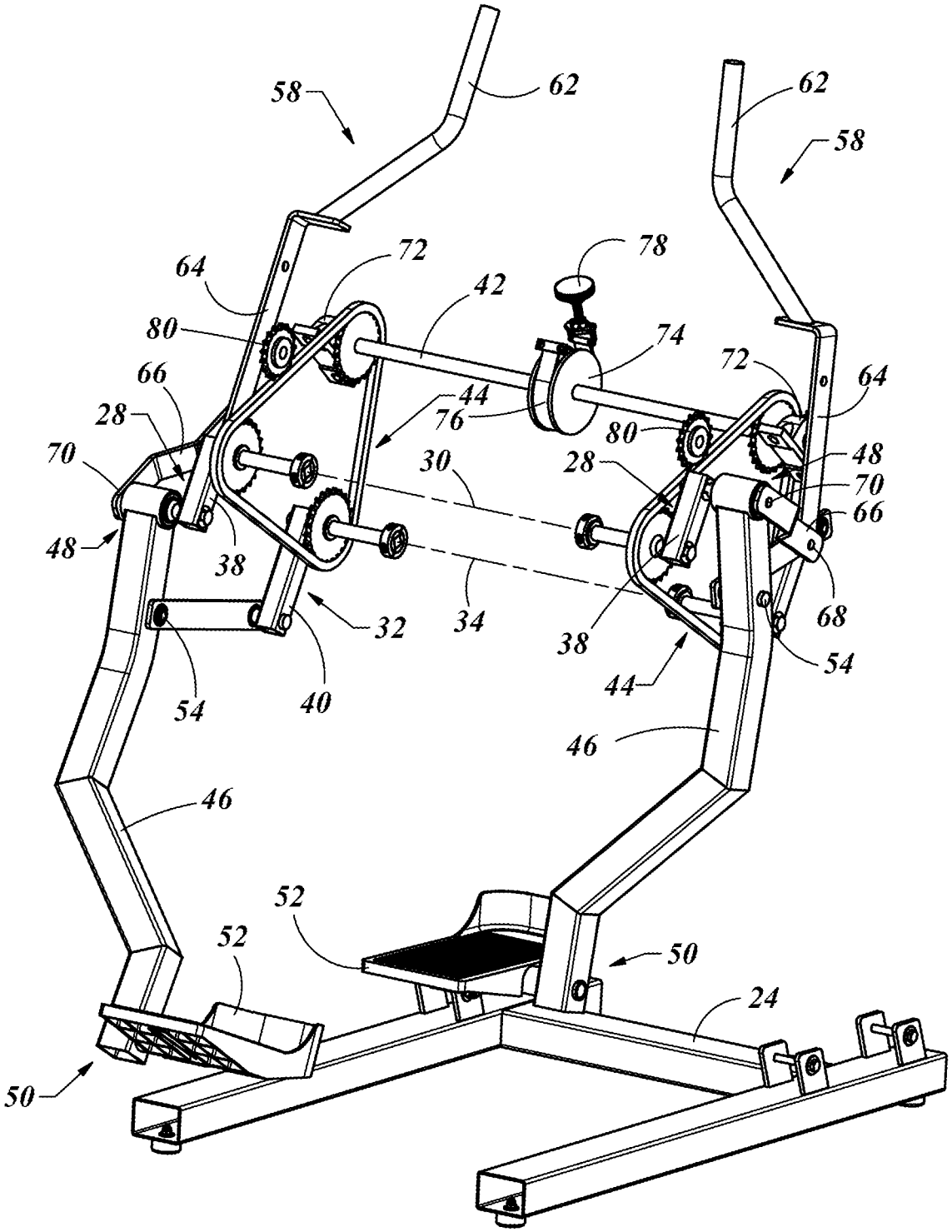
FIG. 5 is an isometric view from the right rear of the exercise device as shown in FIG. 3 with a portion of the frame removed to more clearly show detail of the system.

With particular attention to FIG. 5, the support frame 26 has been removed to better illustrate this embodiment of the present invention 20. The elements as previously shown and described are consistent with that as presented above. What may also be more clearly seen in this figure is the potential use of a tension device to optimize the function of the control system 44. As noted, the control system 44 may include a roller chain or drive belt. It may be desirable to use an idler pulley 80 positioned relative to the drive belt or roller chain of the control system 44 so as to displace a portion of the roller chain or drive belt, thus creating proper tension in the drive belt or roller chain to optimize the function of the control system 44.

Figure 6:
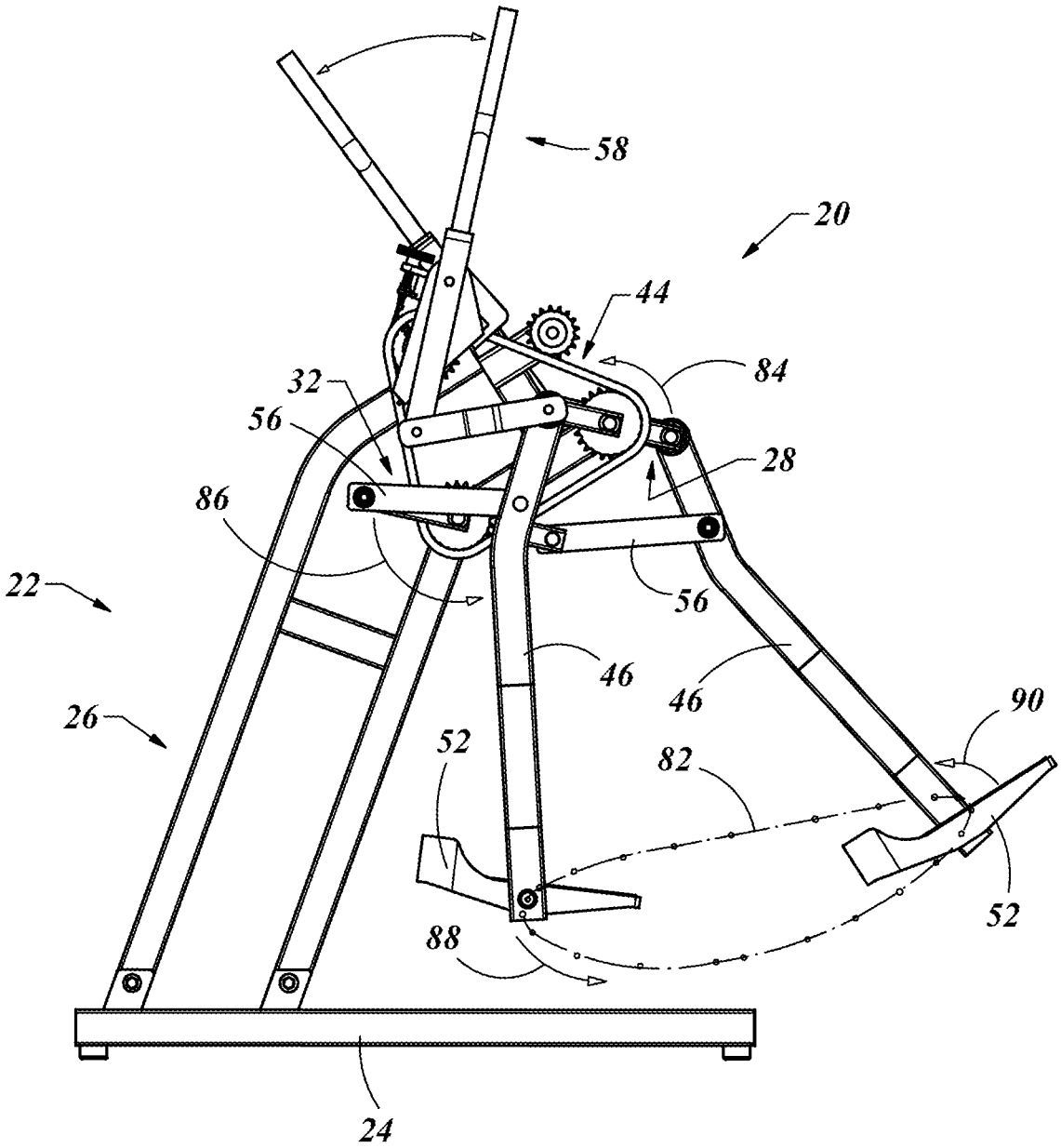
FIG. 6 is a side view of the exercise device as shown in FIG. 3, and illustrating a tracing of the movement of the pedals.

With regard to FIG. 6, a side view of the exercise device 20 is shown with a trace of a pedal path 82. In this view it can be seen how the pedal arms 46 may be connected to the first crank assembly 28. As the first crank assembly 28 rotates in the direction of the drive arrow 84 the pedal arm 46 on the left may move downward while the pedal arm 46 on the right may move upward. The control system 44 may provide the same direction of rotation of the second crank assembly 32, as designated by the second arrow 86. As the second crank assembly 32 rotates in a counter clockwise direction (in this view), the second crank assembly 32 may drive the crank link 56 to alter the angular orientation of the pedal arms 46, as they are driven by the first crank assembly 28. In this view and in this relative position of the pedal arms 46, the pedal arm 46 on the left may move generally down and to the right, as shown by the first pedal arrow 88, while the pedal arm 46 on the right may move generally up and to the right until it changes direction to move to the left and moving down as illustrated by the second pedal arrow 90. An example of a complete path of the pedals 52 may be shown moving along the trace of the pedal path 82.

It may be desirable to change the resistance of the exercise device 20. Any number of users may have different physical capabilities and therefore it may be desirable to have the exercise device conform to those varying capabilities. In addition, as a person uses an exercise device, it is likely the person's physical fitness level will improve. As such, in order to continue to make physiological gains from the exercise, it may be desirable for the exercise device to increase in its ability to stress the body of the user by increasing the workload.

Figure 7:
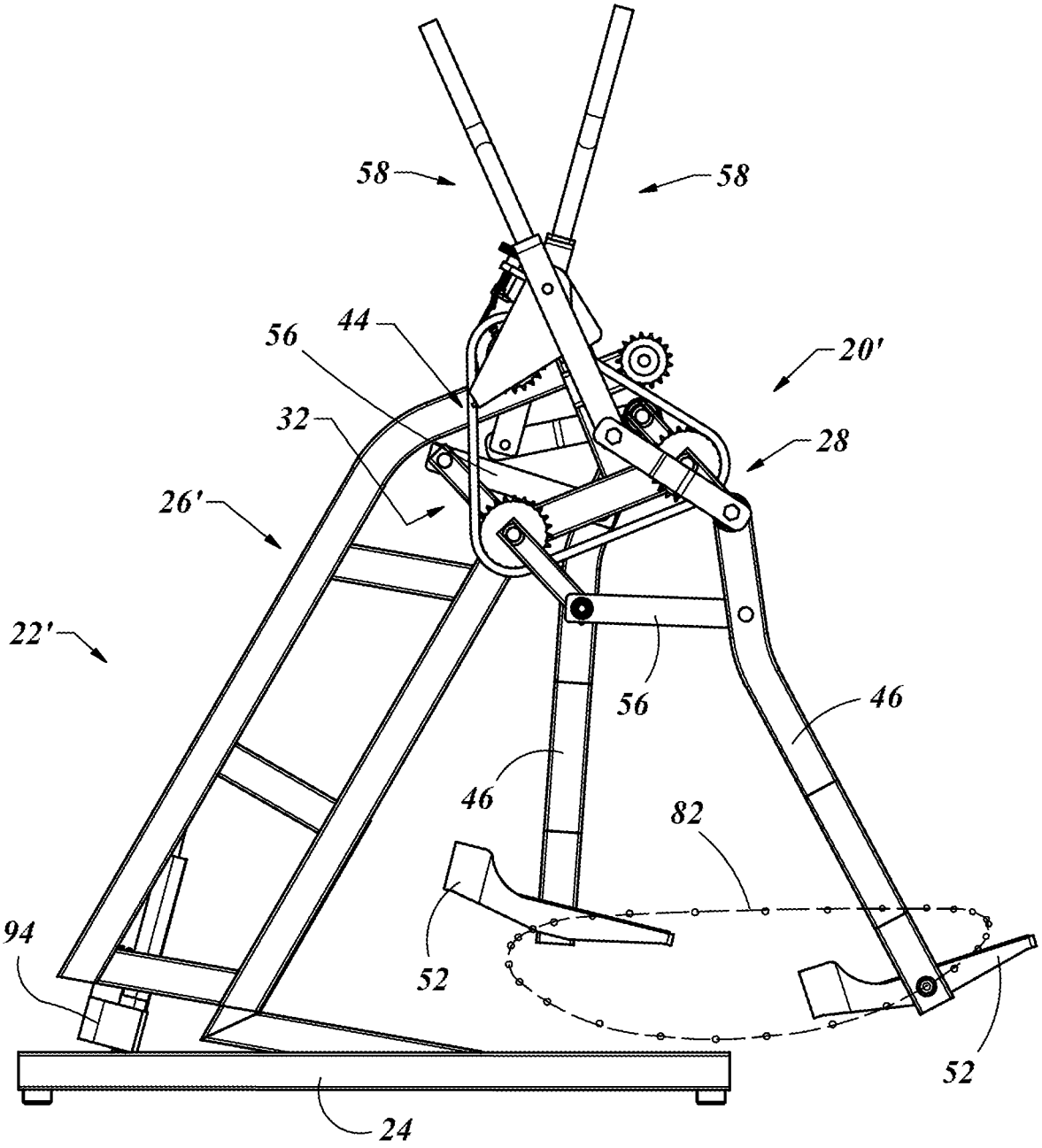
FIG. 7 is a side view of a modified version of the exercise device shown in FIG. 3, wherein the upper frame may be movably mounted to the base frame, a tracing of the pedal path at this inclined position is shown in contrast to the flat position of the upper frame in FIG. 6.
Figure 8:
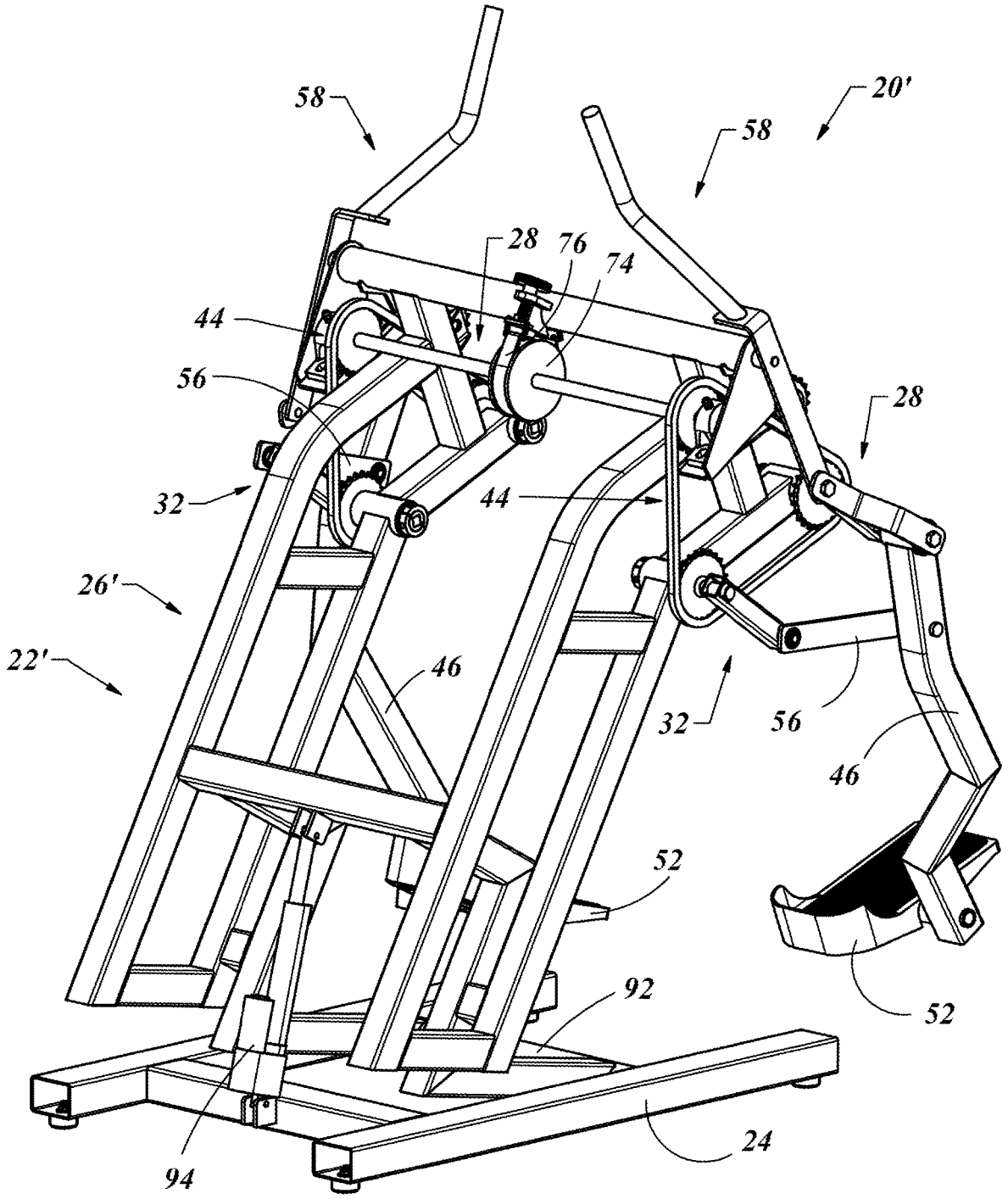
FIG. 8 is an isometric view from the front left of the exercise device shown in FIG. 7.
Figure 9:
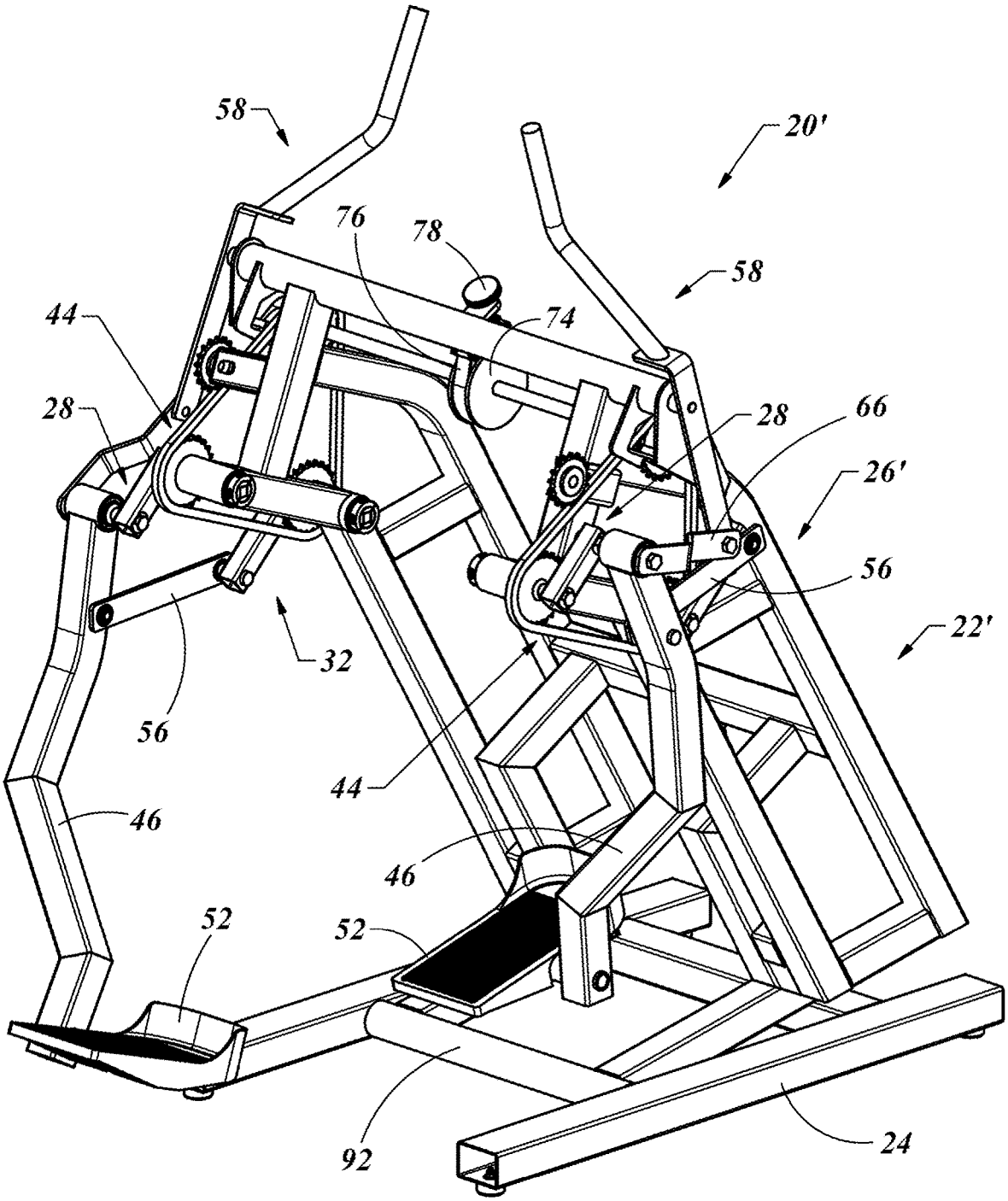
FIG. 9 is an isometric view from the right rear of the exercise device shown in FIG. 7.
Figure 10:
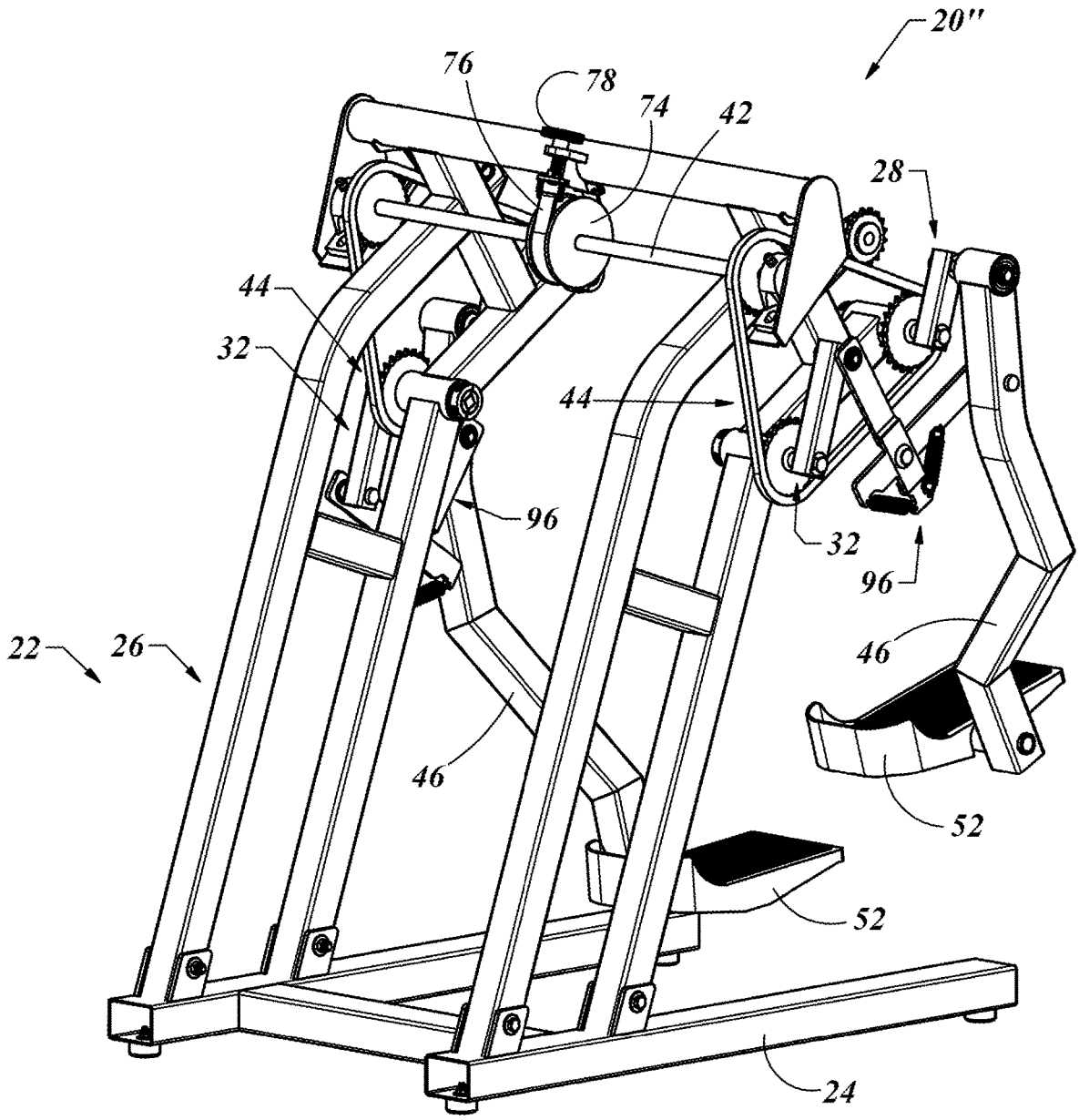
FIG. 10 is an isometric view from the left front of the exercise device as shown in FIG. 1 but where the rigid crank links have been replaced with movable crank links.
Figure 11:
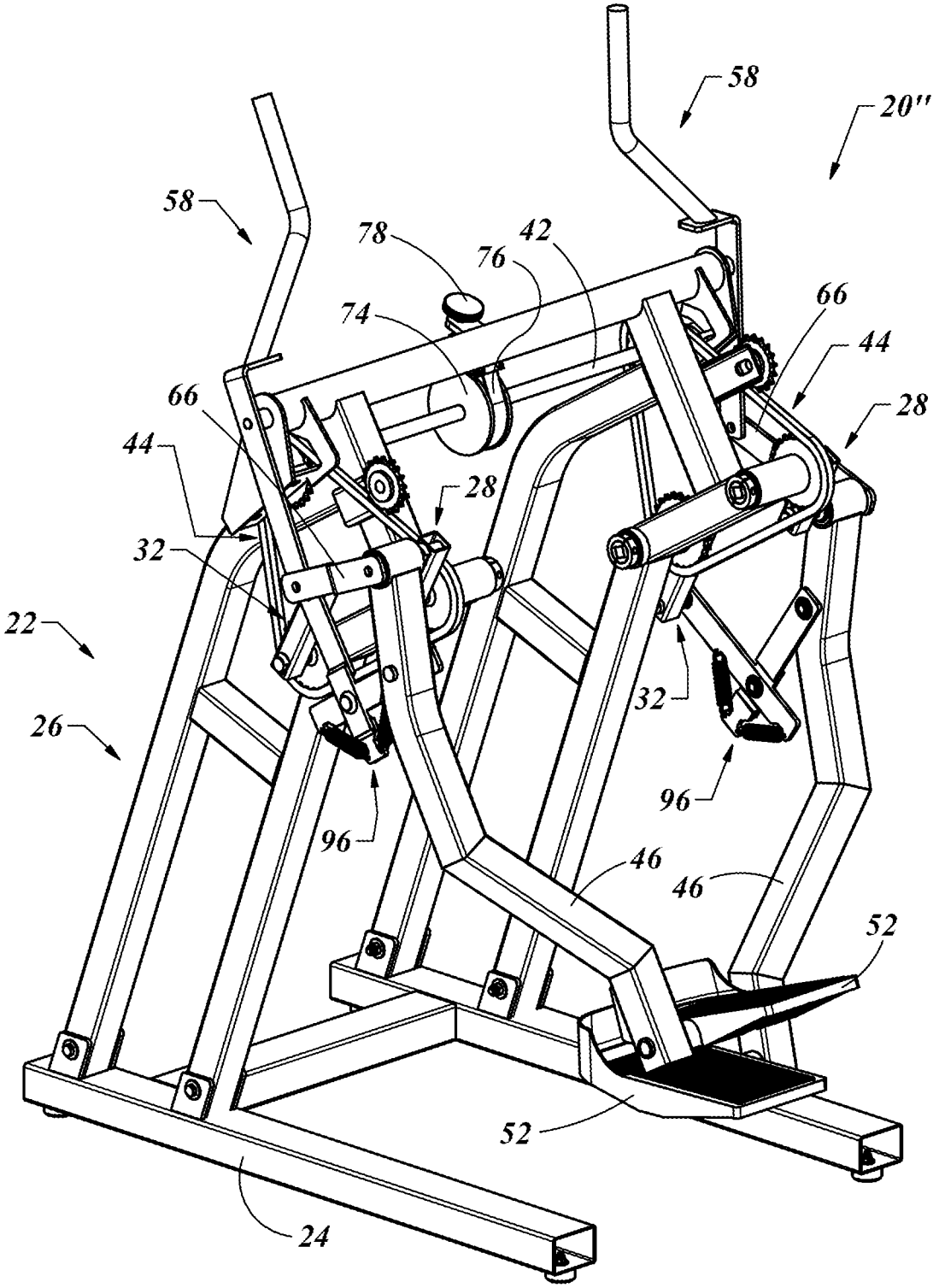
FIG. 11 is an isometric view from the left rear of the exercise device as shown FIG. 2, but where the rigid crank links have been replaced with movable crank links.

As noted, one method to increase the workload in the present exercise device 20 is by providing resistance to rotation of the flywheel 74 by way of the friction strap 76 or any other form of resistance, such as any number of electromagnetic braking systems. An alternative may be to increase the angle of the pedal path. A solution to do so is illustrated in FIGS. 7-9. As was shown in FIG. 6, the trace of the pedal path 82 may be similar to that of a normal walking gait of a person. This walking gait may be similar to that of a person walking on a treadmill with no incline. To increase the caloric expenditure the user may increase the incline or grade of the treadmill deck. According to the American College of Sports Medicine, a person walking on a flat 0% grade versus walking the same speed at a 10% grade will have an estimated metabolic requirement of over 2.3 times greater walking at the inclined grade. Therefore, changing the angle of incline of the gait pattern of the user may also increase energy expenditure of the user during the exercise session. In that a walking gait may result in significantly lower impact stress on the joints of the user, it may be desirable for a user to exercise in this manner as opposed to running and expend a similar amount of energy per unit of time performing the inclined walking exercise.

With regard to FIGS. 7-9, an alternative version of the exercise device 20' is shown which may incorporate the ability to change the angle of the pedal path of the user. The frame 22' may include the base frame 24, which may be supported on the ground or floor as with the other embodiments. The support frame 26' may include a support frame pivot 92, which may be coupled to the base frame 24. This may allow the support frame 26' to change its angular orientation with respect to the base frame 24 by pivoting about the support frame pivot 92. An actuator 94 may be positioned between the base frame 24 and the support frame 26' wherein as the actuator 94 extends, the angle between the support frame 26' and the base frame 24 may be increased.

As may be illustrated in FIG. 7, the trace of the pedal path 82 may have the same overall shape as that shown in FIG. 6 where the exercise device 20 is at a standard flat position, but the trace of the pedal path 82 may be rotated in FIG. 7 in accordance with the increase in angle of the support frame 26' relative to the base frame 24. This may allow a user to increase the workload of the exercise session to a varying degree according to the amount of incline the user selects between the support frame 26' and the base frame 24.

It may be desirable to enable the user to change the stride length of the pedal path. An example of how this may be accomplished is shown in FIGS. 10-14. The general function of the exercise device 20" may be the same as previously shown and described with the exception of the crank link 56 may be replaced with a movable crank link 96. The movable crank arm 96 may include a first link 98 and a second link 100, which may be pivotally coupled about a crank link pin 102. A first spring 104 may be coupled to the first link 98 and the second link 100 and in a similar but opposite manner, a second spring 106 may likewise be coupled to the first link 98 and the second link 100. The orientation of the first spring 104 and the second spring 106 may apply a balanced couple to the first link 98 relative to the second link 100 so that the distance "x" between the bearing attachments 108 may be biased to a predetermined dimension. Though the movable crank arm 96 may be biased to a dimension "x" between the bearing attachments 108, if a force is applied to the movable crank arm 96 in a direction to decrease the value of "x", the first spring 104 may increase in length and the second spring 106 may decrease in length.

A spring may obey "Hook's Law" in that the force needed to deform a spring by some distance is proportional to that distance. Therefore in this example, if a force is applied to cause the distance "x" to decrease, as depicted by the compression arrows 110 shown in FIG. 12, the length of the first spring 104 may increase and therefore the force applied by the spring to the first link 98 and the second link 100 would also proportionally increase. The length of the second spring 106 may decrease, and therefore the force applied to the first link 98 and the second link 100 by the second spring 106 may proportionally decrease. The opposite may be found in that as force is applied to the movable crank link 96 that results in increasing the dimension "x", as depicted by the extension arrows 112, the first spring 104 may decrease in length (and applied force) and the second spring 106 may increase in length (and applied force).

The result is the movable crank link 96 may allow for the dimension "x" to be increased or decreased by forces applied to the movable crank link 96, but the action of the first spring 104 and the second spring 106 may provide a pair of forces that may be balanced optimally when the dimension "x" is at a predetermined value. This combination may allow for displacement of the first link 98 relative to the second link 100 of the movable crank link 96 to allow the value of "x" to vary, but yet provide a bias to return the orientation of the movable crank link 96 to that so the dimension "x" may be a predetermined value.

Figure 12:
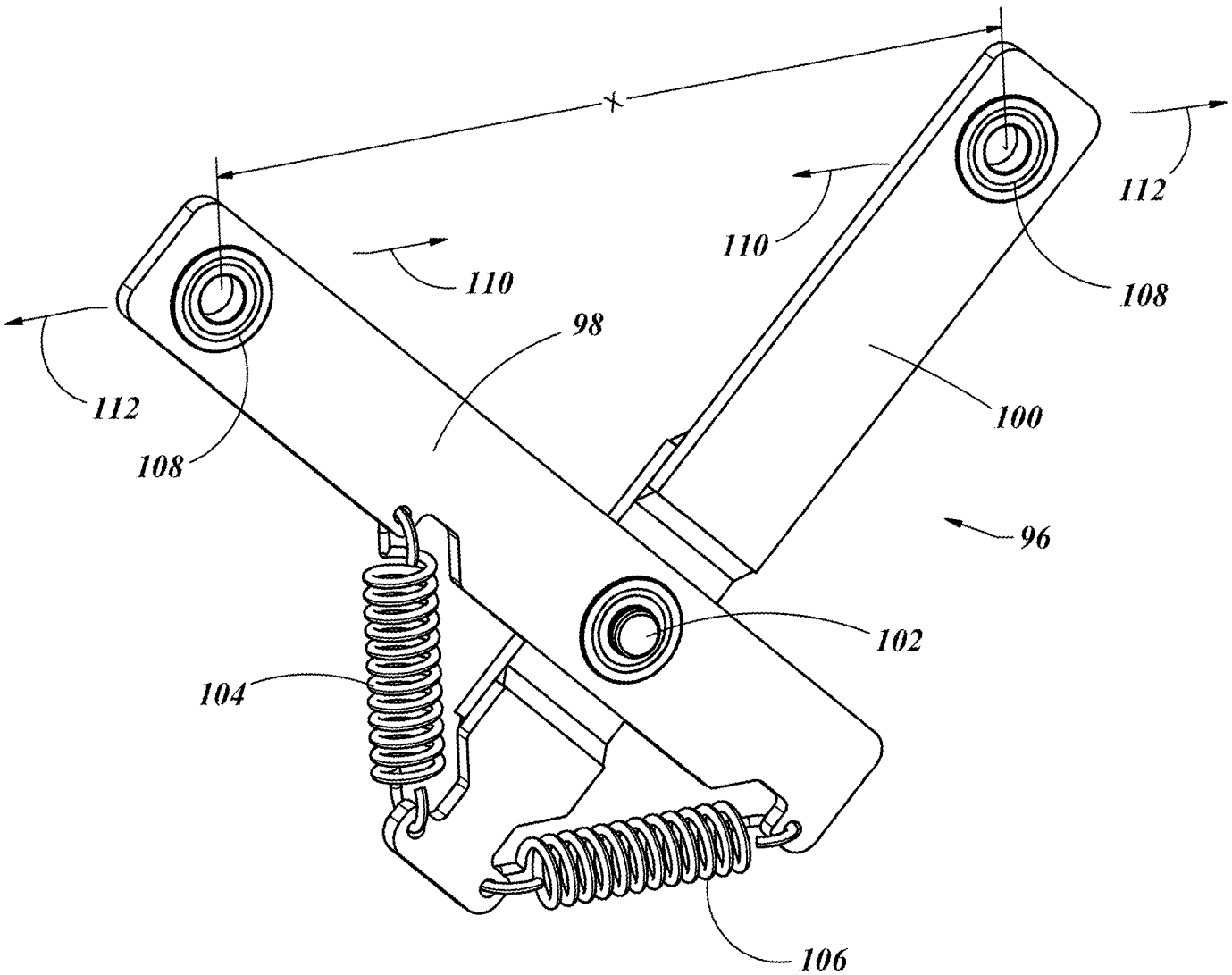
FIG. 12 is an isometric view of a movable crank link removed from the rest of the exercise device as shown in FIG. 11.
Figure 13:
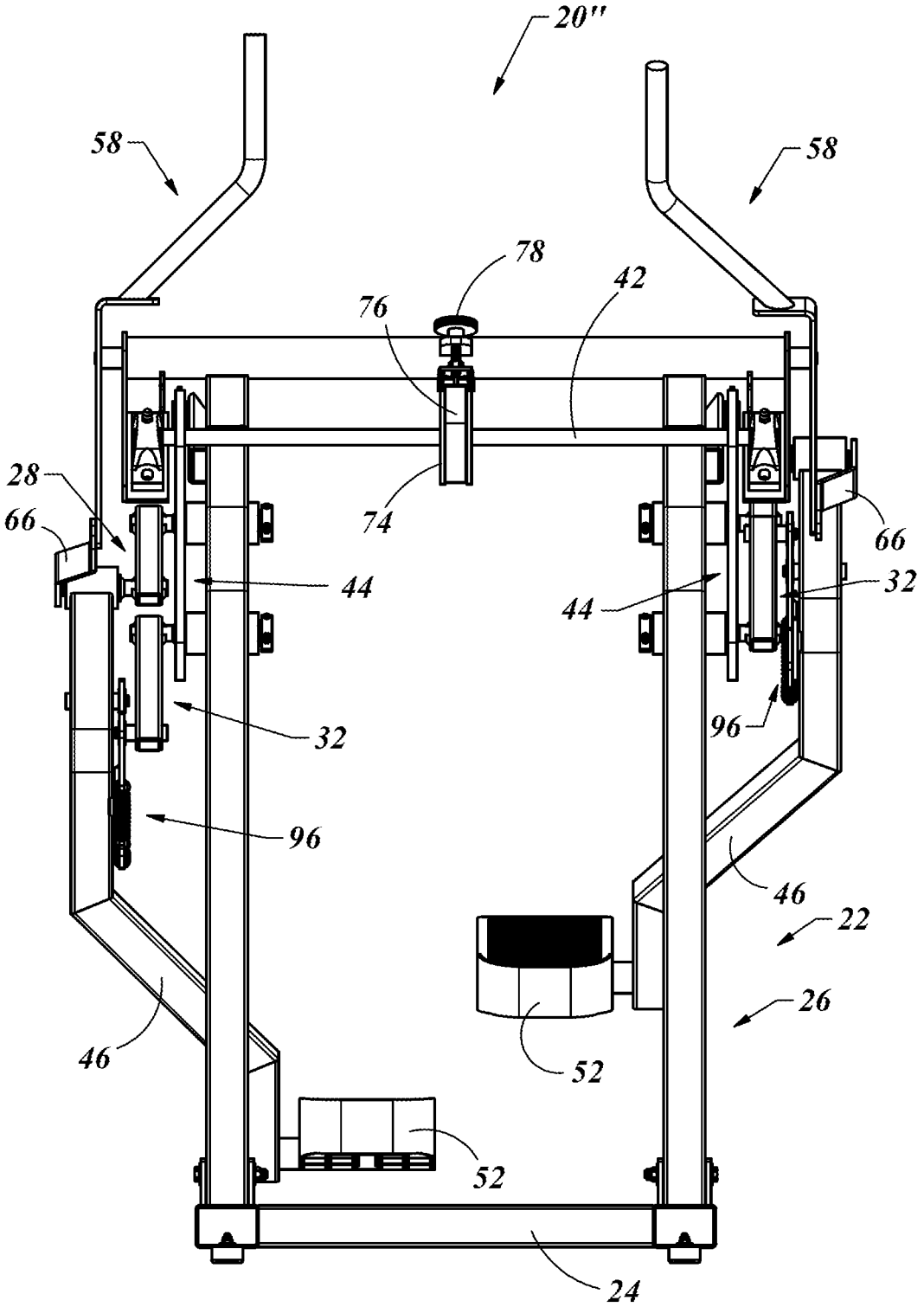
FIG. 13 is a front view of the exercise device as shown in FIG. 11.
Figure 14:
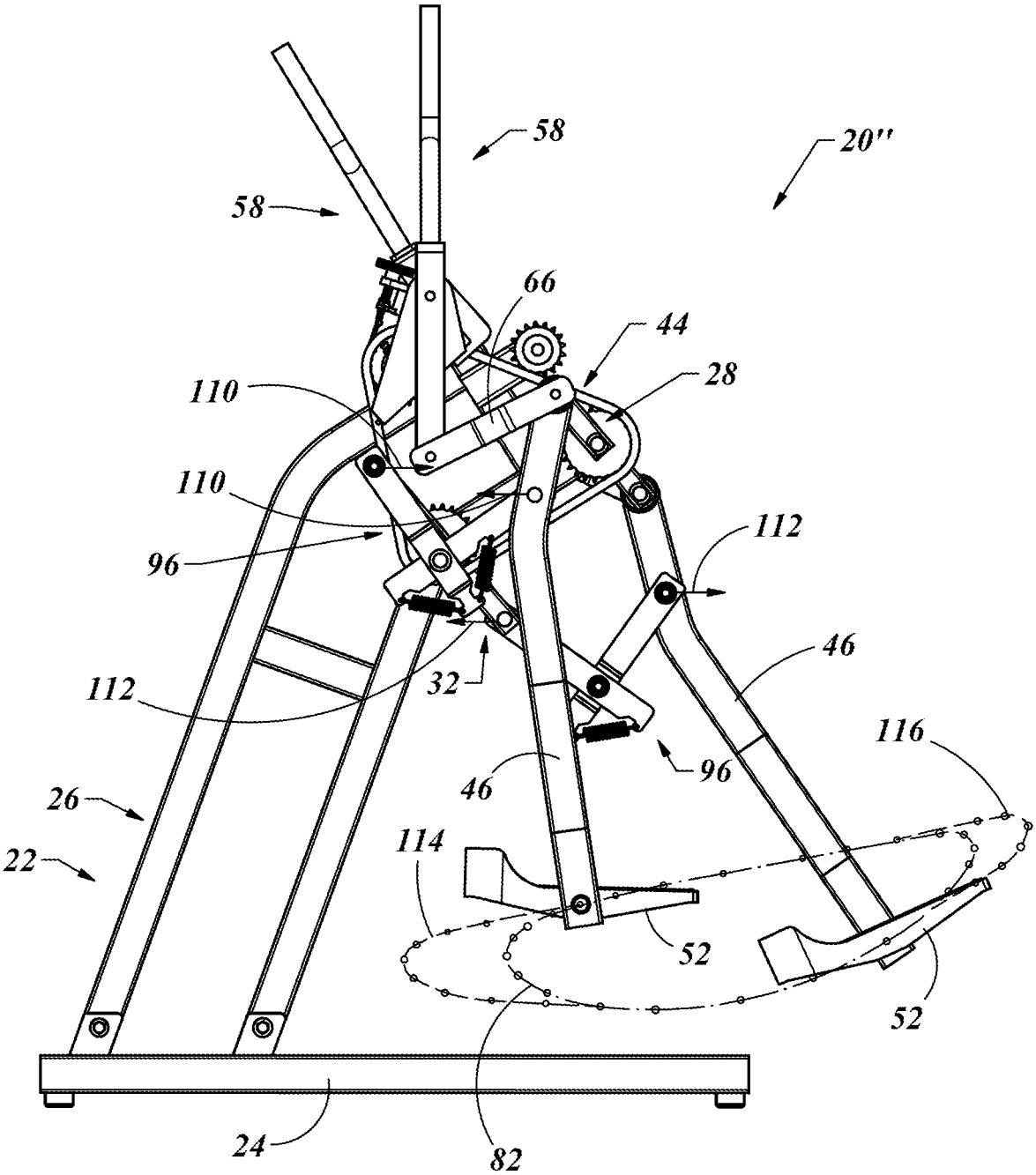
FIG. 14 is a side view of the exercise device as shown in FIG. 11 illustrating the tracing of the pedal paths of the movable crank links in a neutral position and also as may be seen when the movable crank links are moved by the user.

When used on the exercise device 20", the force applied to the movable crank links 96 may be applied by the user to the pedals 52. This may be illustrated in more detail in FIG. 14, where the previously illustrated trace of the pedal path 82 is presented as it may be generated if the movable crank links 96 maintain a set angular orientation of the first link 98 relative to the second link 100, so as to provide a constant dimension "x", as shown in FIG. 12. If the user provides a force to the forward pedal 52 (left one pedal in FIG. 14) to extend it forward beyond the trace of the pedal path 82, a force may be applied to the movable crank link 96 coupled to the forward pedal arm 46 (left one in FIG. 14) to provide a force to move the movable crank link 96 in the direction of the compression arrows 110, or to reduce the value of dimension "x". This may allow the pedal 52 supporting the front foot to extend beyond the trace of the pedal path 82 on the forward pedal 52 (left in FIG. 14) to generate a front pedal path trace extension 114.

In a similar but opposite manner, if the user wishes to extend the pedal 52 supporting the back foot farther back than what may be illustrated by the trace of the pedal path 82, the user may apply a force to the rear pedal 52, (right one in FIG. 14) which may cause the movable crank link 96 connected to the pedal arm 46 supporting the rear pedal 52 (right one in FIG. 14) to move in the direction of the extension arrows 112, or to increase the value of dimension "x". This may allow the pedal 52 supporting the rear foot to extend beyond the trace of the pedal path 82 on the rear pedal 52 (right one in FIG. 14) to generate a rear pedal path trace extension 116. The combination may provide an increased stride length of the pedals 52, which may accommodate a taller person, or anyone else that may want a longer stride length. This may be accomplished by the user overcoming the resistance provided by the first spring 104 and the second spring 106 as needed and to the extent desired by the user.

Figure 15:
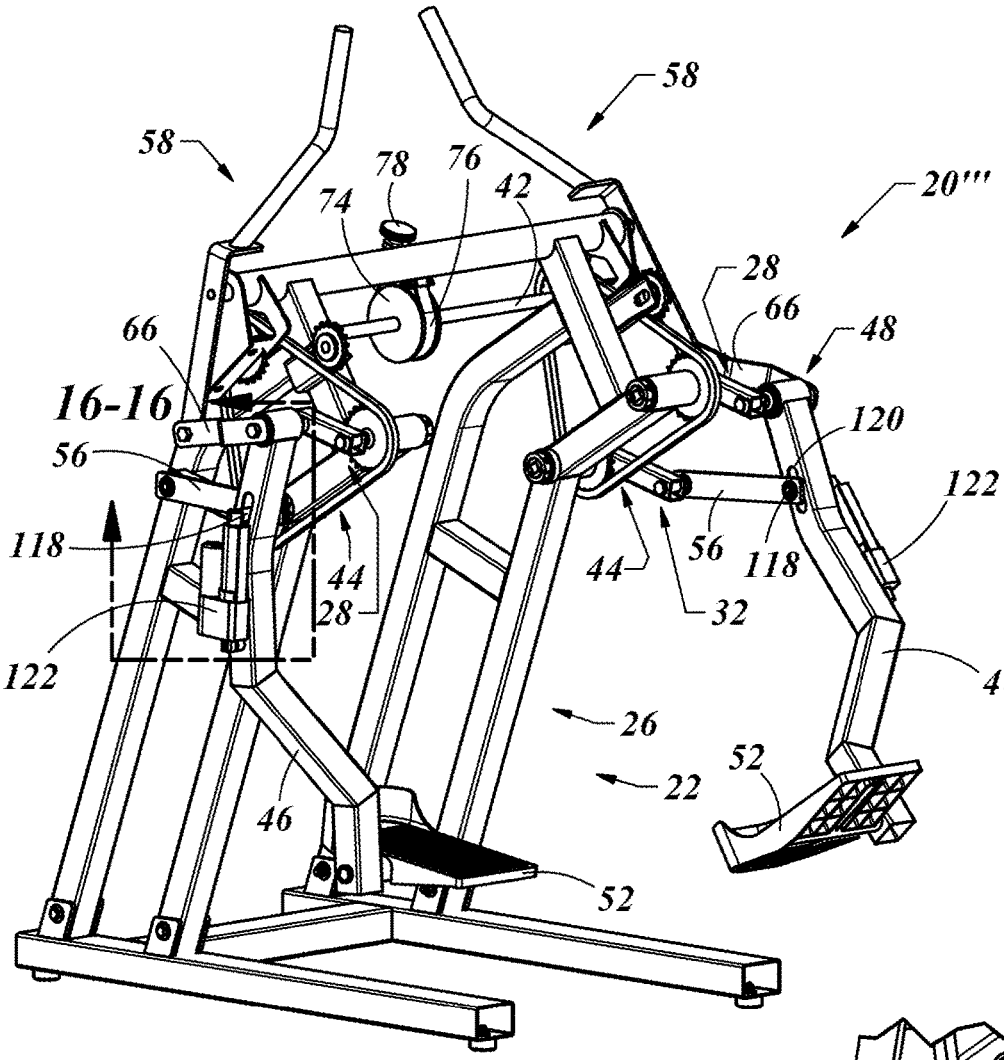
FIG. 15 is an isometric view from the left rear of an exercise device produced in accordance with the present invention in which the crank link pin is movably mounted on the pedal arm.
Figure 16:
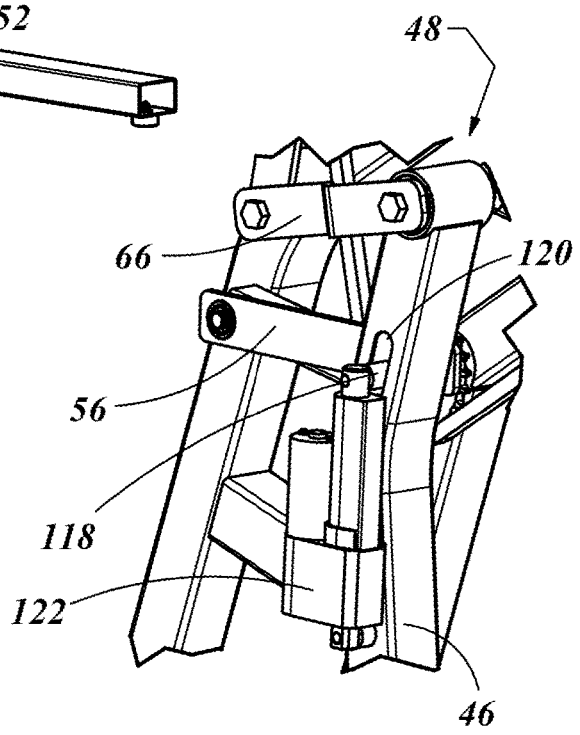
FIG. 16 is a detailed view of the crank link pin and pedal arm as shown in FIG. 15, the view cut along the line 16-16 in FIG. 15.
Figure 17:
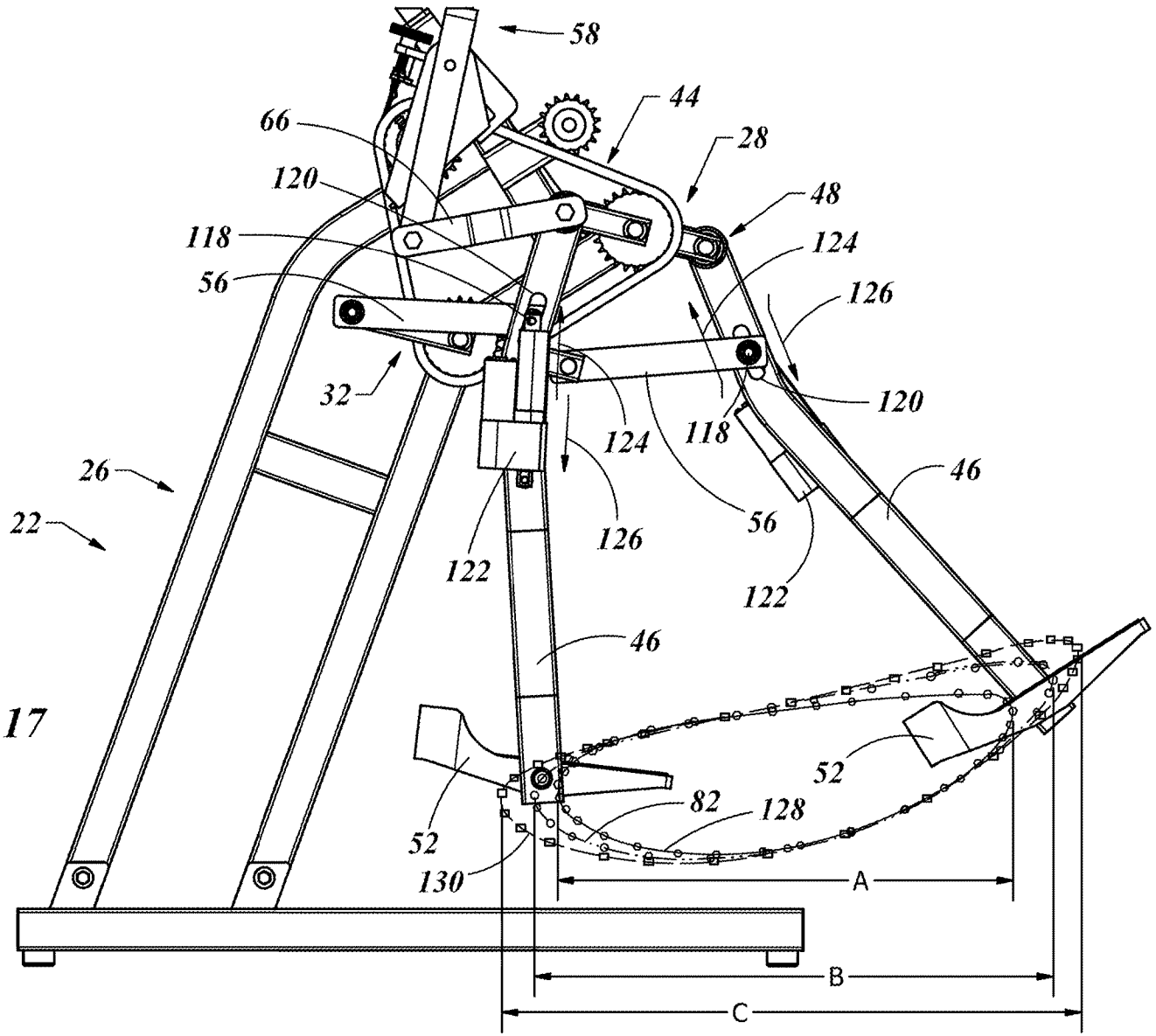
FIG. 17 is a side view of the exercise device as shown in FIG. 15 including the tracing of the pedals as altered by the movement of the crank link pin on the pedal arm.
Figure 18:
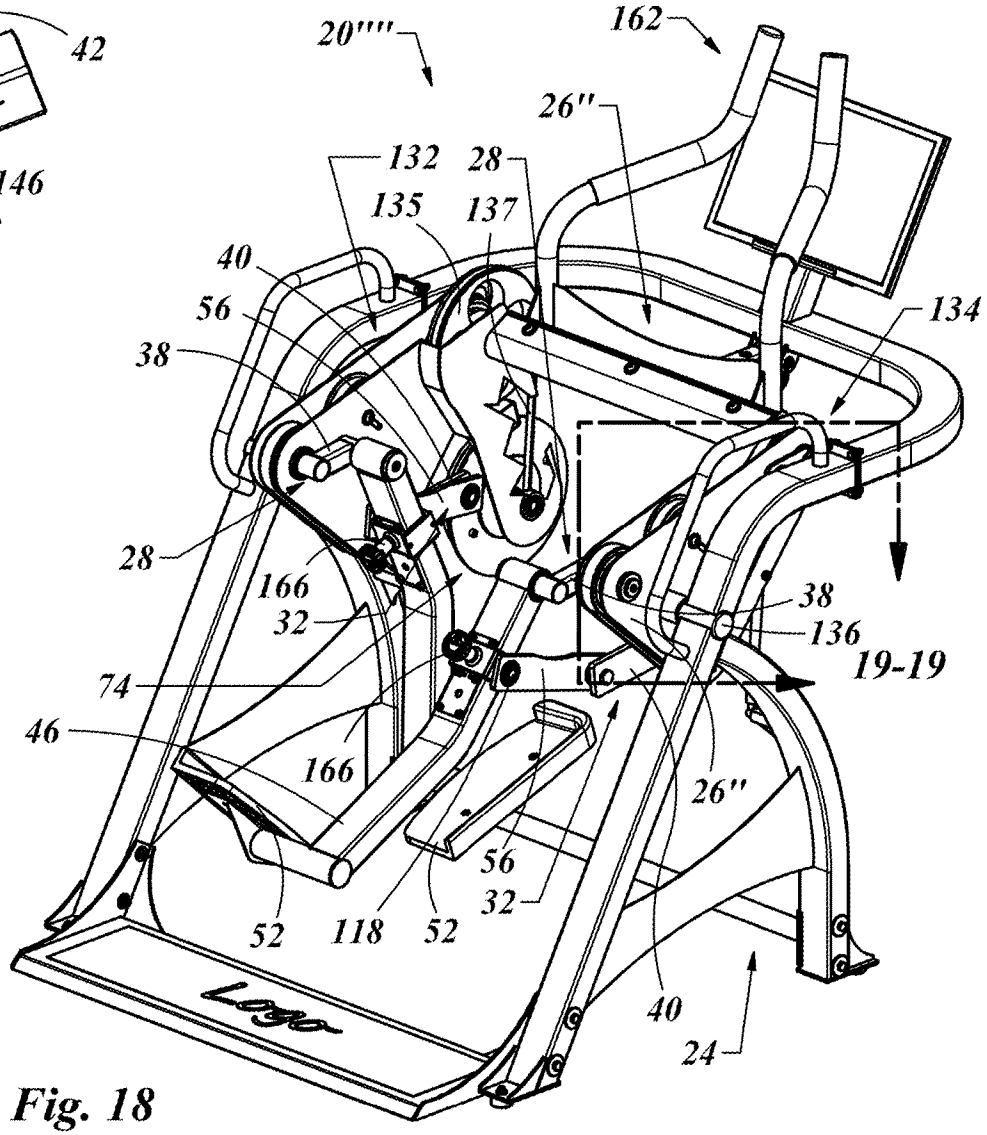
FIG. 18 is an isometric view of an alternative embodiment of the exercise device as shown in FIG. 1.
Figure 19:
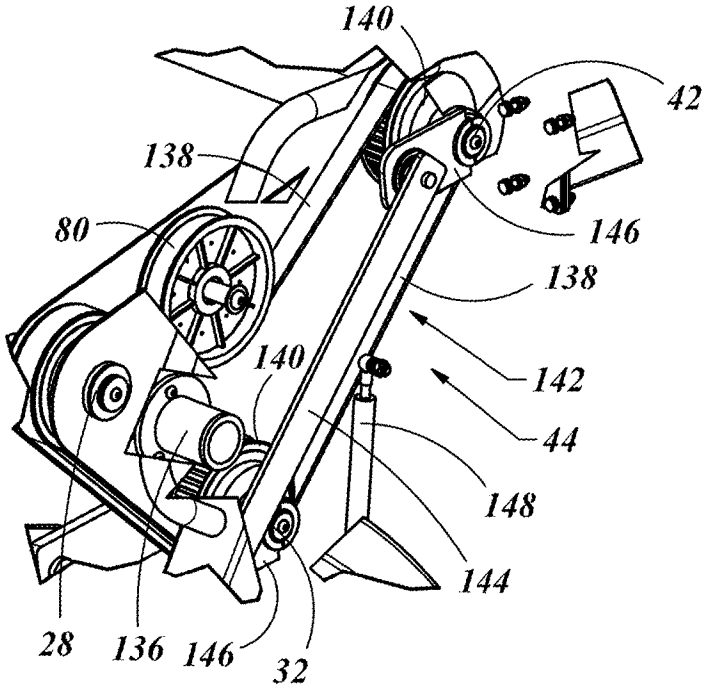
FIG. 19 is a detail cut away of the drive frame and transmission of the exercise device of FIG. 18, cut along line 19-19.
Figure 20:
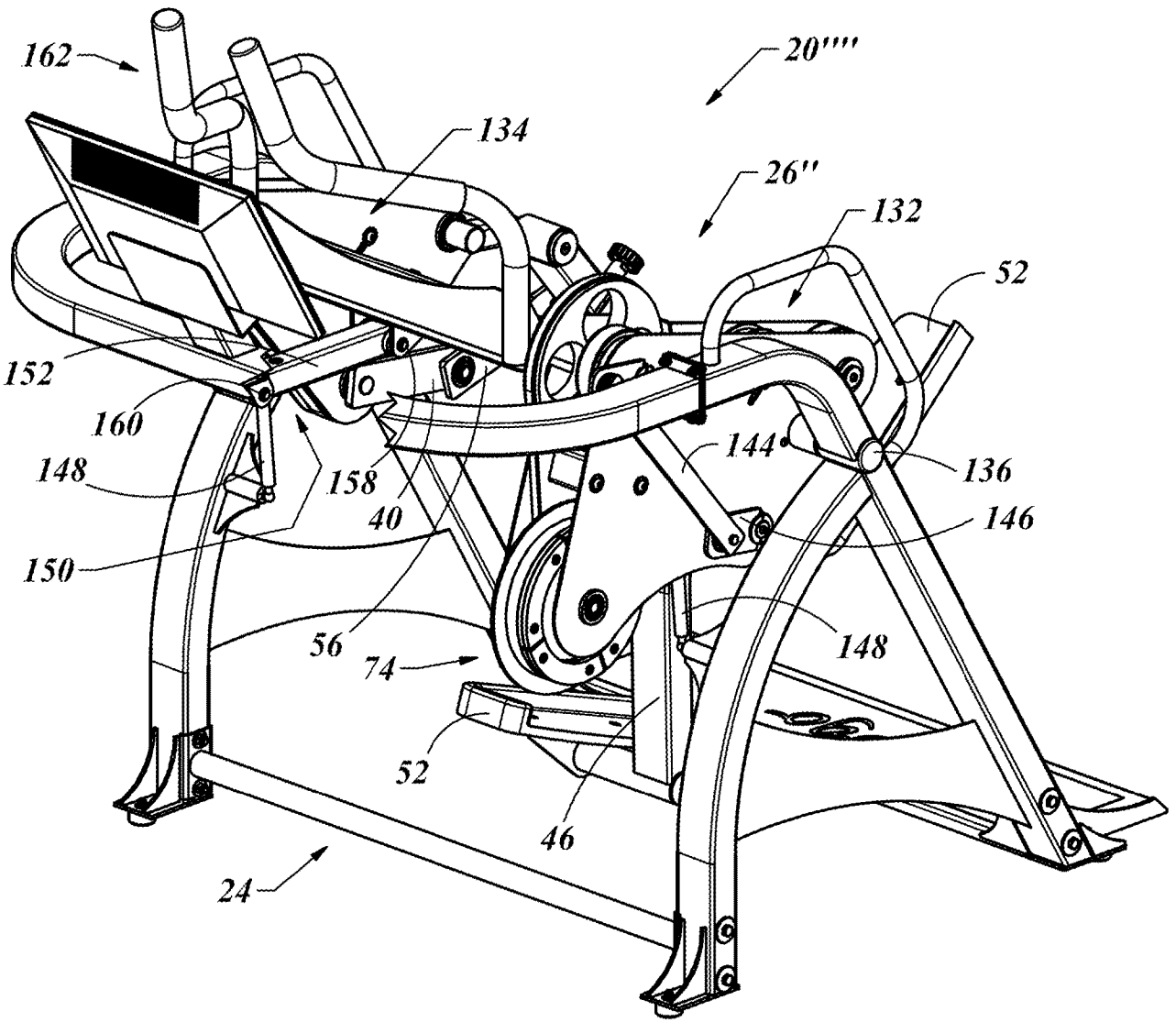
FIG. 20 is an isometric view of the exercise device of FIG. 18, shown from a front, side perspective with a portion of the base frame removed.

Another option to vary the stride length of the pedals 52 is presented in FIGS. 15-17. In this embodiment of the exercise device 20'" the crank link 56 may be used, or the movable crank link 96 as disclosed previously. As previously noted, the movable crank link 96 may enable a system in which the user may alter the stride length by simply using a longer stride length in their gait and the exercise device 20" may conform to the user's foot path of travel. In FIGS. 15-17 a system is illustrated which may provide a set stride length that is adjustable. It is possible to use both the movable crank link 96 as disclosed with the adjustable system illustrated in FIGS. 15-17. That combination is not shown though it is understood that this combination is inherently part of this disclosure.

With regard to FIGS. 15-17, an exercise device 20'" is shown in which the crank link pin 54 of the previous embodiments may be replaced with a movable link pin 118. The movable link pin 118 may be slidably or pivotally mounted to the pedal arm 46. It is shown to be received by a slot 120 in the pedal arm 46, but this slot 120 is not critical. The movable link pin 118 may be mounted to the linear slide, or pivotally coupled to the pedal arm 46, in any way that is known in the art, so that a controlled movement of the movable link pin 118 may be provided. An actuator 122 may be used to move the movable link pin 118 on the pedal arm 46 closer to, or further from, the first end 48 of the pedal arm 46. If the movable link pin 118 is moved up closer to the first end 48 of the pedal arm 46, as illustrated by the up arrows 124, the stride length of the pedal 52 may be increased. If the movable link pin 118 is moved down, farther from the first end 48 of the pedal arm 46, as illustrated by the down arrows 126, the stride length of the pedal 52 may be decreased. This adjustment of the relative position of the movable link pin 118 as moved by the actuator 122 may be adjusted by the user before an exercise session begins or with a system that may be powered, such as with the actuator 122, the adjustment may be also accomplished while the user is performing the exercise. A simple screw adjustment or even a movable but locking movable link pin 118 system may be used where the user may adjust and lock the movable link pin 118 in a set position prior to beginning the exercise session.

The horizontal displacement of multiple stride lengths of the pedals 52 that may be provided by varying the position of the movable link pin 118 is illustrated in FIG. 17. The trace of the pedal path 82, as previously presented, may be shown as a midpoint of the location of the movable link pin 118. This may provide a horizontal dimension of the trace of the pedal path 82 as identified by the value "B". If the movable link pin 118 is moved in accordance with the down arrows 126, thereby increasing the distance between the movable link pin 118 and the first end 48 of the pedal arm 46, a shorter pedal path 128 may result. The shorter pedal path 128 may be associated with a smaller horizontal displacement identified as "A". If the movable link pin 118 is moved closer to the first end 48 of the pedal arms 46, as noted by the up arrows 124, a greater stride length may result. The longer pedal path 130 may be associated with the greater horizontal displacement identified as "C".

If the movable link pin 118 is used with a constant length crank link 56, as shown, the adjustment in the stride length may provide a series of set pedal paths (82, 128, 130) or any infinite number of variations to those shown. Each path may be a result of the settings of the exercise device 20''' and therefore stable to the user, as the user may not be able to alter the pedal paths without making an adjustment to the position of the movable link pin 118. This stability may be desirable to some users in that their body may be fully supported on the pedals 52 of the exercise device 20'''. Using the movable crank link 96 with the adjustable stride length system as provided by the movable link pin 118 together may provide a system which allows for the user to vary their stride length where the path of the pedals 52 comply with that of the user, and an adjustable baseline path of the path of the pedals 52 may be provided by the movable link pin 118 and set in accordance with the desire or some physical characteristics of the user.

Another embodiment of the exercise device 20'''' is shown in FIGS. 18-23. With attention to FIGS. 18-20, the support frame 26'' may be comprised of first drive 132 and a second drive 134, each coupled to the support frame 26''. The support frame 26'' may be movably coupled to the base frame 24 by way of a pivot joint 136. The first drive 132 and the second drive 134 may be positioned such that a person may position themselves between the first drive 132 and the second drive 134. The support frame 26'' may also support the drive shaft 42, which may be in mechanical communication with the flywheel 74. The first drive 132 and the second drive 134 may each support a first crank assembly 28 and a second crank assembly 32 in such a manner such that the first crank arm 38 of the first crank assembly 28, coupled to the first drive 132 may be one hundred and eighty degrees out of phase from the first crank arm 38 of the first crank assembly 28, coupled to the second drive 134. In a similar manner, the second crank assembly 32 may include a second crank arm 40 coupled to the first drive 132 that may be one hundred and eighty degrees out of phase from the second crank arm 40, coupled to the second drive 134. The first crank arm 38 and the second crank arm 40 may be parallel to each other on both the first drive 132 and the second drive 134.

A drive pulley 135 may be mounted to the drive shaft 42. The drive pulley 135 may be in mechanical communication with the flywheel 74 by way of a drive belt 137. A braking system may be coupled to the flywheel 74 so that resistance provided to the flywheel 74 may offer a resistance to movement of the drive shaft 42, which in turn may offer a resistance to movement of the pedals 52. This combination may offer a form of exercise resistance to the user.

The control system 44 may include a drive member 138, which may take the form of a belt, roller chain, a synchronous belt, a v-belt, a poly-v belt or any other power transmission system known in the art. The drive member 138, as shown here in the form of a belt, may be tensioned by the idler 80. A drive pulley 140 may be secured to the first crank assembly 28 and the second crank assembly 32 on both the first drive 132 and the second drive 134. The drive member 138 may be limited to a belt or other power transmission system alone. Alternatively it may be advantageous to provide a secondary power transmission system in the form of a torque linkage 142. This may include a link rod 144 that may be coupled to the second crank assembly 32 and the drive shaft 42 by way of a pair of clamp links 146. This torque linkage 142 may be used to supplement the drive member 138 when high torque is applied to the second crank assembly 32 by the user. The braking system may be applied to the flywheel 74, as such, the highest load may be seen between the second crank assembly 32 and the drive shaft 42. The use of the torque linkage 142 may allow the drive member 138 to be designed for the lower torque associated with extended use by a user and when high forces are applied by the user, such as during sprinting or high incline "hiking" movements, the torque linkage 142 may supplement the power transmission, taking any excessive stress off the drive member 138. This may help eliminate the possibility of drive member 138 jumping a tooth of one of the drive pulleys 140 without the need to over engineer the drive member 138 and drive pulleys 140 for stresses that are only seen occasionally and for short durations.

The torque linkage 142 is shown here to connect the second crank assembly 32 to the drive shaft 42, which may be connected to the braking system. This combination may experience the highest forces and that is why it is shown in this configuration. It is understood that one or more torque linkages 142 may connect any one or more combinations between the first crank assembly 28, the second crank assembly 32 and the drive shaft 42.

Figure 22:
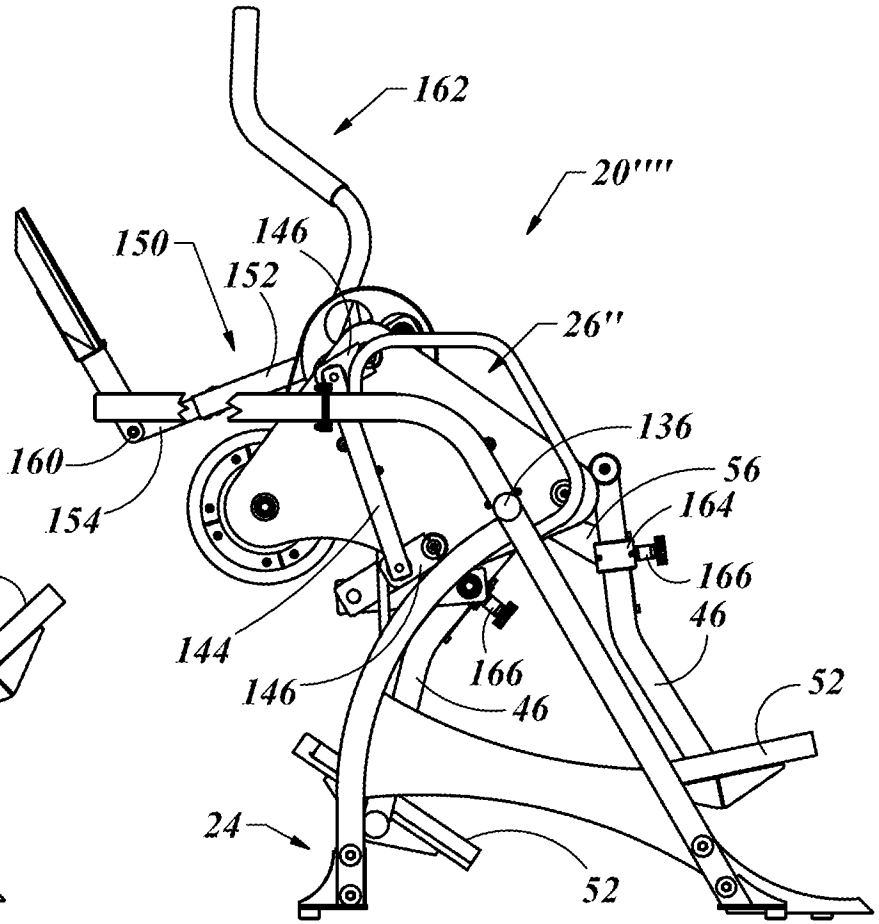
FIG. 22 is a side view of the exercise device of FIG. 21, shown in an inclined orientation.
Figure 21:
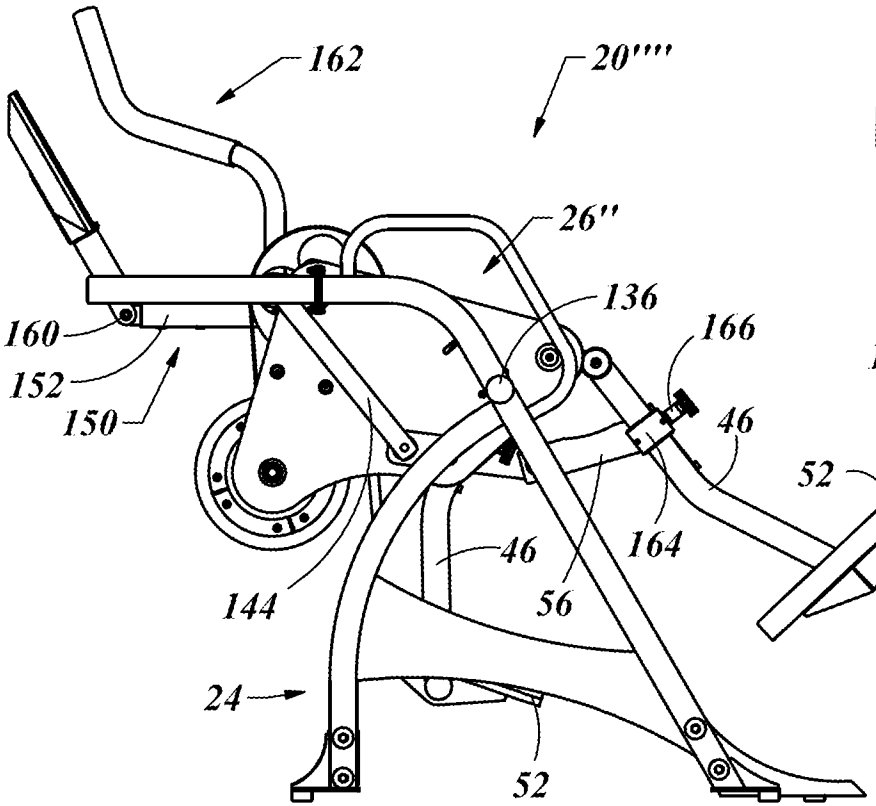
FIG. 21 is a side view of the exercise device of FIG. 18 shown in a non-inclined orientation.
Figure 23:
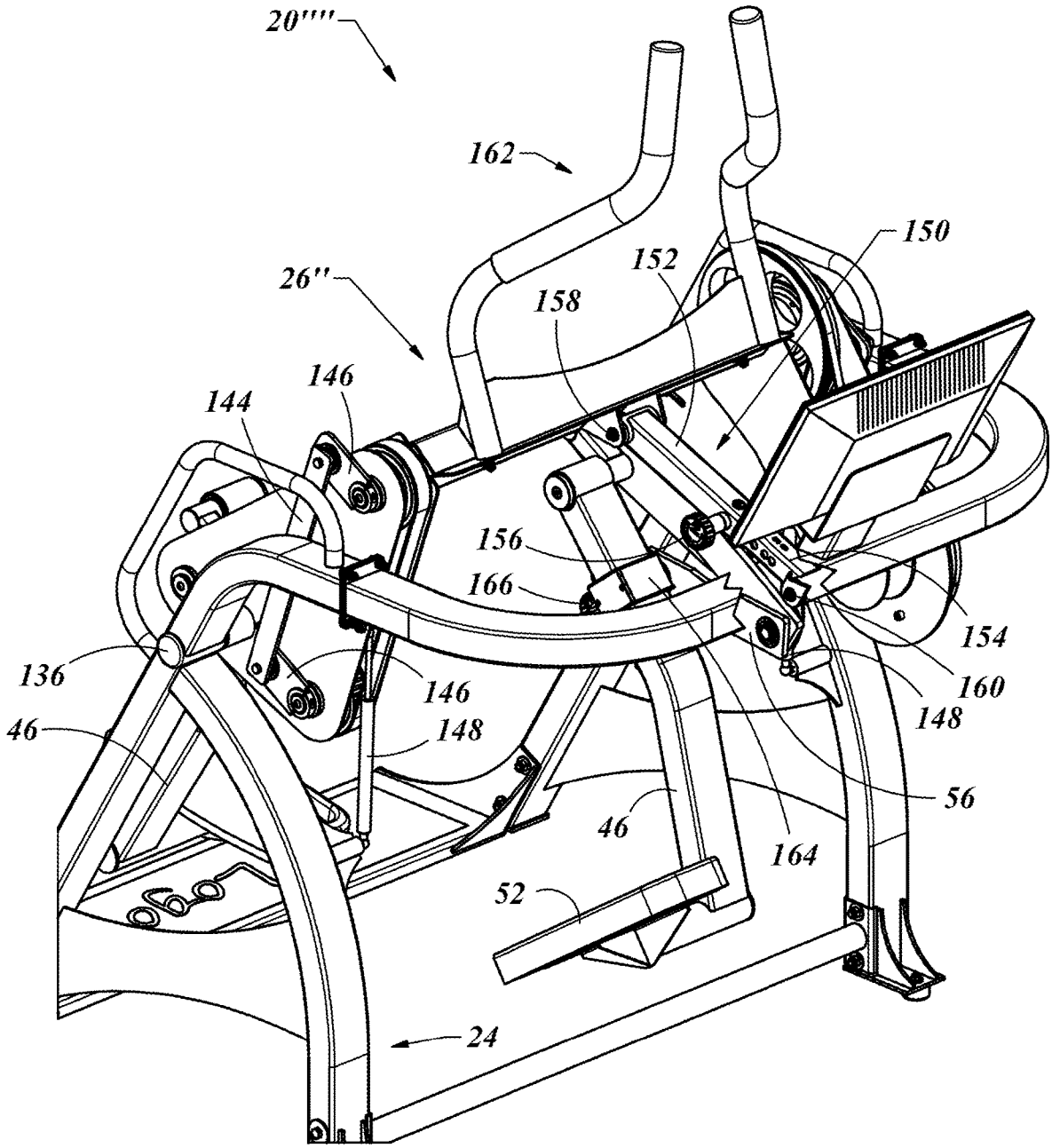
FIG. 23 is an isometric view of a portion of the exercise device of FIG. 22, shown from a front, side perspective with a section of the base frame removed.

The transfer of the higher forces that may be added by the user to the torque linkage 142 may be generated by the user by positioning the exercise device 20'''' in a configuration so as to simulate walking up a hill. In this embodiment, this may be accomplished by altering the position of the support frame 26'' and all the elements supported by the support frame 26'' with respect to the base frame 24. One method of doing this is illustrated in FIGS. 21-23. The support frame 26'' may be pivotally coupled to the base frame 24 about the pivot joint 136. One or more counterbalance springs 148 may be coupled to the support frame 26'' and to the base frame 24 to counter any torque the support frame 26'' may provide at rest about the pivot joint 136 due to the weight of the support frame 26'' and the other elements coupled to the support frame 26''. This counterbalance spring 148 may be in the form of a gas spring. An actuator, such as a linear screw actuator, may be substituted for one or both of the counterbalance springs 148 shown here. In that embodiment, the actuator may drive the front portion of the support frame 26'' up or down and thereby change the angular orientation of the support frame 26'' relative to the base frame 24. By changing this orientation, the pedal path, as shown in previous figures, may also change, as inclining the front of the support frame 26'' up may cause the pedal path to simulate walking up a hill.

To reduce production costs, compared to using linear actuators in place of the counterbalance springs 148, the gas springs may be used as the counterbalance springs 148 with an incline adjustment 150. The incline adjustment 150 may include a first support 152, which may articulate with a second support 154, and a locking pin 156 to releasably secure the first support 152 to the second support 154 at desired positions. This may securely alter the dimension between a support frame pin 158 and a base frame pin 160. By increasing the dimension between the support frame pin 158 and the base frame pin 160, exercise device 20"" may produce an inclined pedal angle from flat (as shown in FIG. 21) to an inclined position (as shown in FIG. 22). The user may disengage the locking pin 156, move the support frame 26" to a desired position, being aided by the counterbalance springs 148, and then engaging the locking pin 158 to secure the support frame 26" and therefore the first drive 132 and the second drive 134, to a desired level of incline.

In this embodiment the drive handles 58 of previous embodiments have been removed and a set of stationary leaning handles 162 are shown. These handle types are not mutually exclusive to any embodiment. The leaning handles 162 may be desirable in some angular orientations of the exercise device 20 and the moving drive handles 58 may be desirable in other orientations, or as a personal preference in any orientation. Either form of handles (moving drive handles 58 or stationary leaning handles 162) may be interchangeably used or in combination together on any embodiment.

A method of altering the pedal path by varying the position of the crank link 56 on the pedal arm 46 has been disclosed. This embodiment of the exercise device 20"" illustrates a manually adjustable version to accomplish this task. An adjustment bracket 164 may be releasably secured to the pedal arm 46 at one or more positions on the pedal arm 46. A leg lock pin 166 may be used to releasably secure the adjustment bracket 164 to a position on the pedal arm 46. The crank link 56 may be pivotally secured to the adjustment bracket 164 at the movable lock pin 118, and as noted before, also to the second crank arm 40. Therefore, by adjusting and securing the adjustment bracket 164 at different positions on the pedal arm 46, the path of the pedals 52 may be altered to achieve more than one pedal path, as previously disclosed.

The foregoing detailed description of the present invention is provided for purposes of illustration, and it is not intended to be exhaustive or to limit the invention to the particular embodiment shown. The embodiments may provide different capabilities and benefits, depending on the configuration used to implement key features of the invention.

What is claimed is:

1. An exercise device comprising:

a frame;

a first and a second crank system mounted opposing sides of the frame adapted for positioning a user therebetween, each of the first and second crank system including a first crank assembly rotatable about a first axis and a second crank assembly rotatable about a second axis with the first and second axes being displaced from the other;

each of the first crank assemblies including a first crank arm and each of the second crank assemblies including a second crank arm;

a pair of drive belt assemblies mechanically coupled to the pair of crank systems respectively, each drive belt assembly of the pair of drive belt assemblies being mechanically coupled to the first and second crank assemblies of the corresponding crank system for 360 degrees of synchronous rotation of the first and second crank assemblies, wherein each first crank arm of each first crank assembly rotates in the same direction as the second crank arm of each second crank assembly by the corresponding drive belt assembly of the pair of drive belt assemblies;

a pair of pedal arms respectively coupled to the first and second crank systems, each of the pair of pedal arms including a first end pivotally coupled to the first crank arm of the first crank assembly and a second end to a respective pedal;

a pair of crank links, each of the pair of crank links pivotally coupled on one end to a respective one of the pedal arms and a second end pivotally coupled to the second crank arm of the corresponding second crank assembly; and a pair of torque linkages, each of the pair of torque linkages including a link rod and each of the torque linkages of the pair of torque linkages being mechanically coupled to the first and second crank assemblies of the corresponding crank system, the pair of torque linkages working in parallel with the pair of drive belt assemblies.

* * * * *